United States Patent [19]

Hooper

[11] Patent Number: 4,630,691

[45] Date of Patent: Dec. 23, 1986

[54] ANNULUS BYPASS PERIPHERAL NOZZLE JET PUMP PRESSURE DIFFERENTIAL DRILLING TOOL AND METHOD FOR WELL DRILLING

[76] Inventor: David W. Hooper, 1500 E. Warren Space 82, Santa Ana, Calif. 92705

[21] Appl. No.: 686,241

[22] Filed: Dec. 26, 1984

Related U.S. Application Data

[63] Continuation-in-part of Ser. No. 496,133, May 19, 1983, abandoned.

[51] Int. Cl.[4] ..... E21B 7/00

[52] U.S. Cl. ..... 175/65; 175/213; 175/325; 166/187

[58] Field of Search ..... 175/65, 324, 325, 320, 175/215, 230, 213; 166/179, 187

[56] References Cited

U.S. PATENT DOCUMENTS

| | | | |
|---|---|---|---|
| 2,643,722 | 6/1953 | Lynes et al. | 166/187 |
| 2,946,565 | 7/1960 | Williams | 175/325 |
| 3,529,667 | 9/1970 | Malone | 166/187 |
| 3,542,127 | 11/1970 | Malone | 166/187 |
| 3,604,732 | 9/1971 | Malone | 166/187 |
| 4,223,747 | 9/1980 | Marais | 175/324 |
| 4,534,426 | 8/1985 | Hooper | 175/215 |

FOREIGN PATENT DOCUMENTS

| | | | |
|---|---|---|---|
| 0623954 | 9/1978 | U.S.S.R. | 175/324 |
| 0653386 | 3/1979 | U.S.S.R. | 175/230 |

*Primary Examiner*—Stephen J. Novosad
*Assistant Examiner*—Bruce M. Kisliuk
*Attorney, Agent, or Firm*—William H. Maxwell

[57] ABSTRACT

A pressure differential drilling tool and method of underbalanced pressure controlled well bore drilling, characterized by a modulating plug closely expanded to the well bore diameter to form an annulus for external bypass of well fluid immediately above the drill bit and through which the drill string continuously makes hole, and by an upwardly disposed peripheral nozzle jet pump with controlled suction of fluid from the bit so as to establish a reduced and/or underbalanced fluid pressure condition at the bit-to-bore bottom interface for operating the drill bit at an increased rate of penetration while maintaining a higher pressure condition in the well bore annulus above the modulating plug controllably expanded by hydraulic pressure applied to operate the jet pump.

40 Claims, 29 Drawing Figures

FIG. 1.
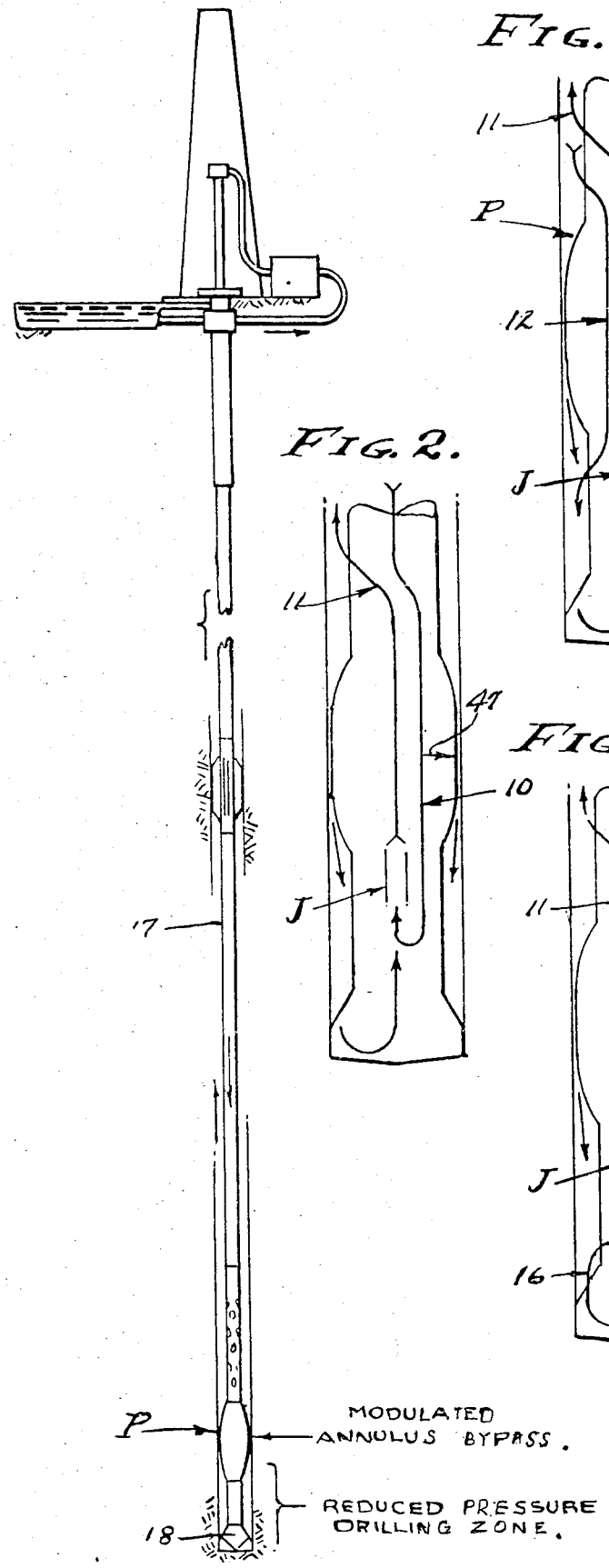
FIG. 2.
FIG. 3.
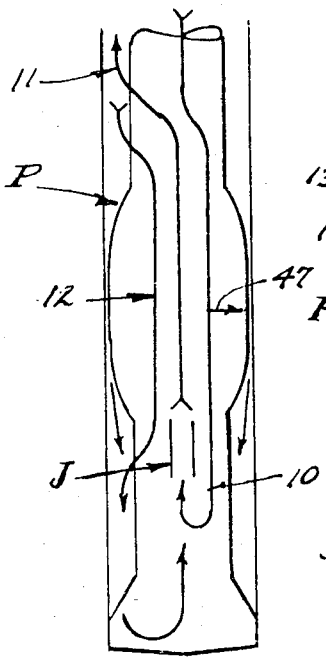
FIG. 4.
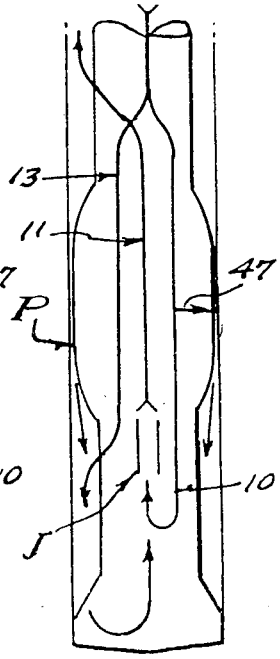
FIG. 5.
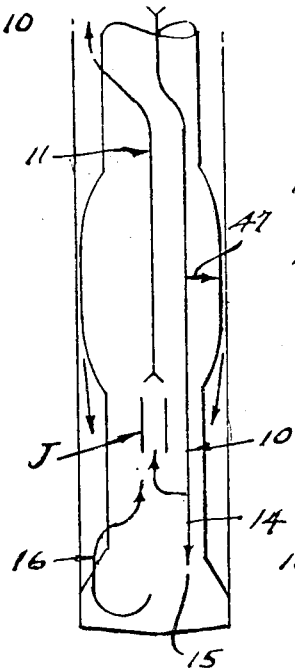
FIG. 6.
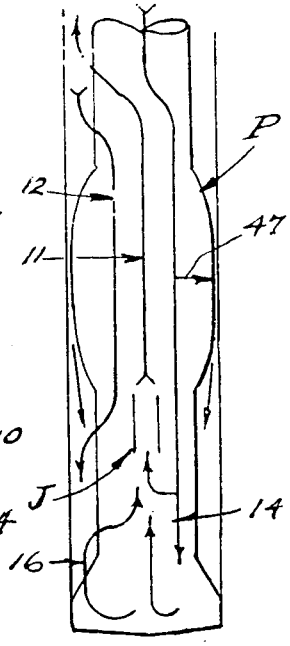

ANNULUS BYPASS PERIPHERAL NOZZLE JET PUMP PRESSURE DIFFERENTIAL DRILLING TOOL AND METHOD FOR WELL DRILLING

This is a continuation in part of my copending application Ser. No. 496,133, filed May 19, 1983 and now abandoned, entitled PRESSURE DIFFERENTIAL DRILLING TOOL METHOD AND APPARATUS FOR WELL DRILLING.

BACKGROUND

This invention is concerned with the rotary method of oilwell drilling wherein hydraulic fluid, usually "mud", is pumped down the drill string and onto the bottom of the hole to clean the bit rollers and to flush the chips up the well bore. A great deal of effort has been expended on bottom hole cleaning coupled with drill bit design, in order to increase penetration rate, and mud pressure and its hydrostatic head is a controlling factor in this drilling efficiency. The weight of the mud is controlled and related to the bottom hole pressure required because of the pore pressure, represented by "formation pressure gradiant", that presents an instantaneous boundary pressure interface of mud-to-formation at and surrounding the drill bit. The formation pressure gradiant varies with depth and type of formation entered into, and it can change rapidly and unexpectedly resulting in "blowouts" or "kicks", which has required blowout prevention equipment installed at the surface as a first line of defense. With these factors in mind, the driller is normally required to proceed with control over weight and pressure to establish an "over balanced" condition by substantially equalizing or exceeding the formation pressure at the bottom of the hole, and it is generally accepted by drillers that in deep-hole drilling the bit hydraulics has a major effect upon the rate of penetration. It is also accepted that the rate of penetration can be increased greatly with "under balanced" conditions at the bit, but normally with the risk of cave-in and uncontrolled implosion of the well bore at and surrounding the lower end of the drill string. In view of the foregoing, it is a general object of this invention to provide a pressure differential drilling tool and method of drilling for increasing the rate of penetration in deep holes.

The formation pore pressure at the bottom of a well bore varies with the depth and the type of formation, and which can be calculated by using as a factor the "formation pressure gradient" of the formation to be penetrated. The average formation pressure gradient in the continental United States is 0.465 p.s.i. per foot of depth: and the maximum abnormal therefor is accepted as 1.0 p.s.i. per foot of depth. The "formation pressure gradient" can be defined as the compaction pressure, the pore pressure, which the formation exhibits and from which condition it can unexpectedly release as in the case of a sudden opening from the formation and into the well bore. With an under balanced condition the formation will become sensitive and tends to implode, for purposes of this invention.

As stated above, the formation pressure gradient is important in the drilling process because it is a factor which determines the need for pressure and hydrostatic head applied in order to keep the formation intact and thereby prevent collapse of the well bore. Conventional bit nozzles or jets are another factor, as they restrict flow and control circulating fluid pressure. Accordingly, pump pressure, jet restriction and hydrostatic head pressure of the mud are the controlling factors employed to establish "over balanced" and "under balanced" conditions as related to the pore pressure and the formation pressure gradient thereof, it being an object of this invention to provide a drilling tool for pressure differential drilling that subjects the well bore bottom interface to an under balanced condition, while subjecting the drill string above the bit to a higher or an overbalanced condition. With the present invention, the differential condition is immediate to the bit, whereby cutting action at the bit-to-bore bottom interface is under balanced for rapid penetration, and whereby the hole above the bit is at higher pressure and/or over balanced for normally accepted pore pressure-mud column equilibrium.

The pressure differential tool and method of drilling herein disclosed is characterized by the pressure separation below and above the bit, thereby establishing distinct pressure zones, it being an object of this invention to substantially isolate the bit zone from the drill pipe zone during the drilling operation, so that an under-balanced condition can prevail at the bit-to-bore bottom interface, and so that a higher pressure or an over balanced condition can prevail above the bit. Accordingly, a modulating plug is provided at and above the bit to closely fill the annulus between the bit (sub or drill collar) and the bore through which the modulating plug continuously advances as hole is made. In practice, a controllably expansible elastomer boot is employed through which the drill string rotates. However, when hydraulic drill motors are employed the drill string is fixed and need not rotate through the modulating plug, although so called mud motors can rotate through the modulating plug as it is disclosed herein.

The present invention requires the controllably expanded modulating plug to slideably engage the well bore closely behind the drill bit, it being an object of this invention to advantageously utilize the modulating plug as a stabilizer. In the normal practice of rotary drilling long lengths of drill collar are commonly used together with winged stabilizers, in order to make straight hole. With the present invention, the bore engageable modulating plug close above the drill bit inherently centers the bit in the well bore, and by stabilizing the drill string with an additional stabilizer substantially above the modulating plug the amount of drill collar can be greatly reduced, as the active portion of the drilling string is then turning on spaced centers. In practice, the lower modulating plug-stabilizer and the upper stabilizer are on sleeve members that turn on the drill pipe or tool bodies through anti-friction bearings, as will be described. Alternately, a non turning drill pipe locates a mud motor on centers (not shown).

It is an object of this invention to control the above mentioned modulating plug during lowering of the drill string and during the drilling operations, and to this end the plug is expansible only in response to the application of hydraulic pressure, and specifically through the application of mud pump pressure. A significant feature is the inclusion of a releasable check valve that bypasses fluid within the tool for rapid descent into the well bore, said valve being removeable so as to open up the tool to fluid passage. The modulating plug is hydraulically operated in response to pressure build-up at the jet pump nozzle, established when mud pump pressure is controllably applied.

A primary object of this invention is to generate a differential pressure in the separated and distinct zones below and above the bit, actually below and above the aforesaid modulating plug immediately above the bit. The drill bit and drill string apparatus is essentially mechanical-hydraulic in its operational functions, and it is the inherent presence of dynamic fluid under pressure that is employed to generate the differential pressure to establish an under balanced condition distinct from a balanced or over balanced condition. A feature of the present invention is the inclusion therein of at least one peripheral nozzle jet pump operable in the tool with control over the bore modulating plug. The jet pump per se operates without moving parts and is capable of lifting a greater volume of fluid than is required therefor through its ejector features for operation. However, it is the differential in pressure between the intake or suction tube (plenum) and discharge mixing throat (venturi) with which this invention is primarily concerned, a differential calculated to reach substantial proportions.

An object of this invention is to provide a well drilling tool with a surrounding bore modulating plug, while advantageously utilizing the tool interior to establish the jet pump features. Characteristically, the body of the tool has cross-over passages that pass drilling fluid and chips to be carried away by the upward flow thereof. A feature is the internal bypass of downwardly flowing circulating fluid from the interior of the drill string and around the jet pump and supplying a nozzle plenum of the jet pump. A feature is the sharing of said internally bypassed circulating fluid under pressure from the interior of the drill string with the modulating plug (static) to controllably expand the same to substantially close the well bore annulus surrounding the tool; and responsive to mud pump pressure that simultaneously controls the static pressure applied to expand the modulating plug and dynamic flow to the jet pump so as to establish the differential pressure between the zones below and above the modulating plug. A feature is the internal controlled bypass of circulating fluid from the well bore annulus above the modulating plug and alternately from the interior of the drill string for discharge of flushing fluid beneath the modulating plug at and surrounding the drill bit. A feature is the internal and upward bypass of upwardly flowing circulating fluid and chips from the centerflow jet pump and into the well bore annulus above the modulating plug.

An object of this invention is to provide a fluid ejector jet pump that is anti bridging and self cleaning. The jet pump as it is disclosed herein is an annular or peripheral nozzle jet pump, a type to be distinguished from a core type jet pump. Core type jet pumps are those with the nozzle centered within the suction tube ahead of the mixing throat, thereby presenting an obstruction subject to bridging with debris; and heretofore core type jet pumps have become clogged with chips when operated in well drilling tools. Distinctively, annular or peripheral nozzle jet pumps do not present an obstruction to the flow of chip laden fluid, since the suction tube and the mixing throat are of one continuous diamater. As will be seen, the peripheral nozzle opening is annular with absolutely no obstruction to the flow passage of maximized cross sectional area, the suction tube continuing unobstructedly into the mixing throat. In practice, the nozzle entry angle is acute, and as shown the mixing throat is slightly restricted to a smaller diameter than that of the suction tube, so that there is a greatly reduced possibility for the suction tube to become clogged or bridged, since the mixing throat if susceptible to bridging is at the discharge side of the pump subject to nozzle action that will errode and brake up debris.

The modulating plug-stabilizer is free to rotate over the drilling string, although it is not set in the well bore to be non rotating. Accordingly, the modulating plug-stabilizer is embodied in a sleeve journaled to turn on a body member that is part of the tool and located above the drill bit. It is an object therefore to provide for anti friction rotation of the sleeve member on the body member, and to provide fluid communciation to the sleeve member from the interior of the body member so as to controllably expand the modulating plug-stabilizer that isolates the bit-to-bore bottom zone.

The modulating plug-jet pump tool that I provide is a basic element of the oilwell drilling apparatus of the present invention, and its utility as thus far described is associated directly with the bit for increasing the rate of making hole. It is the differential pressure control which is of primary concern and to this end it is an object to selectively apply and remove hydraulic pump pressure so as to control the expansion of the plug-stabilizer into centered flow controlling engagement within the well bore. By controlling the proximate expansion or fit of the plug-stabilizer within the well bore, downward leakage of the well bore annulus fluid under static head is restricted as circumstances require.

In view of the foregoing therefore, it is an object of this invention to provide a plug that is restrictively responsive to the application of static fluid pressure which can be determined by mud pump pressure applied to the aforesaid jet pump. That is, there is a pressure drop that appears as mud pump fluid under pressure passes through the jet pump, with a resultant static pressure applied to the modulating plug at the upstream side of the jet pump to expand the same to a predetermined diameter. In carrying out this invention, I provide an expansible elastomer boot that is reinforced by a cage of longitudinally disposed members which are anchored at opposite ends so as to be stretched when internal fluid pressure is applied. It is the resultant tension applied to the cage of said elongate members that expands the boot radially, a degree according to the amount of static fluid pressure applied. The longitudinal cage members are in the nature of staves in the form of narrow straps of spring steel having a known modulus of elasticity and placed edge to edge to form a barrel or cylinder, when relaxed. When internal fluid pressure is applied to the boot, the cage members stretch under tension and bow outwardly so that controlled radial expansion of the plug occurs restrictively to modulate leakage by the said plug-stabilizer.

It is an object of this invention to separately actuate this basic differential pressure drilling tool, whereby underbalanced drilling conditions beneath the bit can be immediately changed to an over balanced condition, when required. Operation of this basic pressure differential drilling tool at the bit can serve as an immediate "first line of defense" against "blow-outs" and "kicks"; thereby relegating conventional blow-out preventers to a "second line of defense". The basic pressure differential drill tool of the present invention can stop blow-outs and kicks at their source. Still further, the basic modulating plug-stabilizer as it is disclosed herein can inherently operate to slide closely within an open hole and in set casings and the like.

SUMMARY OF THE INVENTION

This invention resides in the control of underbalanced pressure drilling by means of a modulating plug-stabilizer used in conjunction with an oilwell drilling string in the rotary method wherein circulating fluid is pumped down the drill string to clean the bore bottom during penetration, and to circulate chips up the annulus of the hole while lining the well bore with colloidal material carried in the fluid, the "mud". The modulating plug-stabilizer is controllably expanded to determine down-hole leakage of mud under static head in the well bore annulus, thereby isolating the bit-to-bore bottom interface zone. The "mud" is circulated by high pressure pumps at the surface, the viscosity and density of which is controlled by specific gravity and by aeration in order to establish a hydrostatic head that balances the hydrostatic bottom hole pressure against the pore pressure of the formation, the average formation pressure gradient factor per foot of depth being about 0.465 p.s.i. Normal drilling operations are conducted at an over balanced condition with the formation pressure gradient in equilibrium or in excess thereof, the hydrostatic head equalling or exceeding the pore pressure; however, over balancing is known to retard the rate of penetration. In order to increase penetration rate under balanced drilling is practiced at the risk of well bore failures; and it is this underbalanced condition with which the present invention is particularly concerned, providing differential pressure control means by which an under balanced condition prevails only at the bit-to-bore bottom interface, with a normal higher pressure or over balanced condition prevailing in the well bore above the bit and modulation plug. Since pressure changes within the well bore, especially at the bottom of the hole, are quite unpredictable during penetration, the pressure differential tool of the present invention is controllable so that an overbalanced condition can be restored immediately and thereby effecting a first line of defense against sudden increases in formation pressures.

The foregoing and various other objects and features of this invention will be apparent and fully understood from the following detailed description of the typical preferred forms and applications thereof, throughout which description references is made to the accompanying drawings.

DESCRIPTION OF THE DRAWINGS

FIG. 1 is a schematic view illustrating the process and apparatus of the present invention.

FIGS. 2 through 6 are flow diagrams illustrating the flow patterns of five forms of the invention: FIG. 2 showing the basic form, FIG. 3 showing the preferred form using a center discharge bit, FIG. 4 showing a modification of FIG. 3, FIG. 5 showing a form using a conventional jet bit, and FIG. 6 showing a modification of FIG. 5 using a center discharge bit.

FIG. 23 showing initial placement of tension staves over the cylinder body of the plug-stablizer, FIG. 24 showing engagement of the bore engageable fabrication over the pressure expansible fabrication, FIG. 25 showing the installation of a retainer sleeve, FIG. 26 showing securement of the cylinder body to a bearing collar, and FIG. 27 showing the complete assembly at one end of the plug-stabilizer with the tension staves in stopped engagement with the cylinder body.

PREFERRED EMBODIMENT

Figure 7:
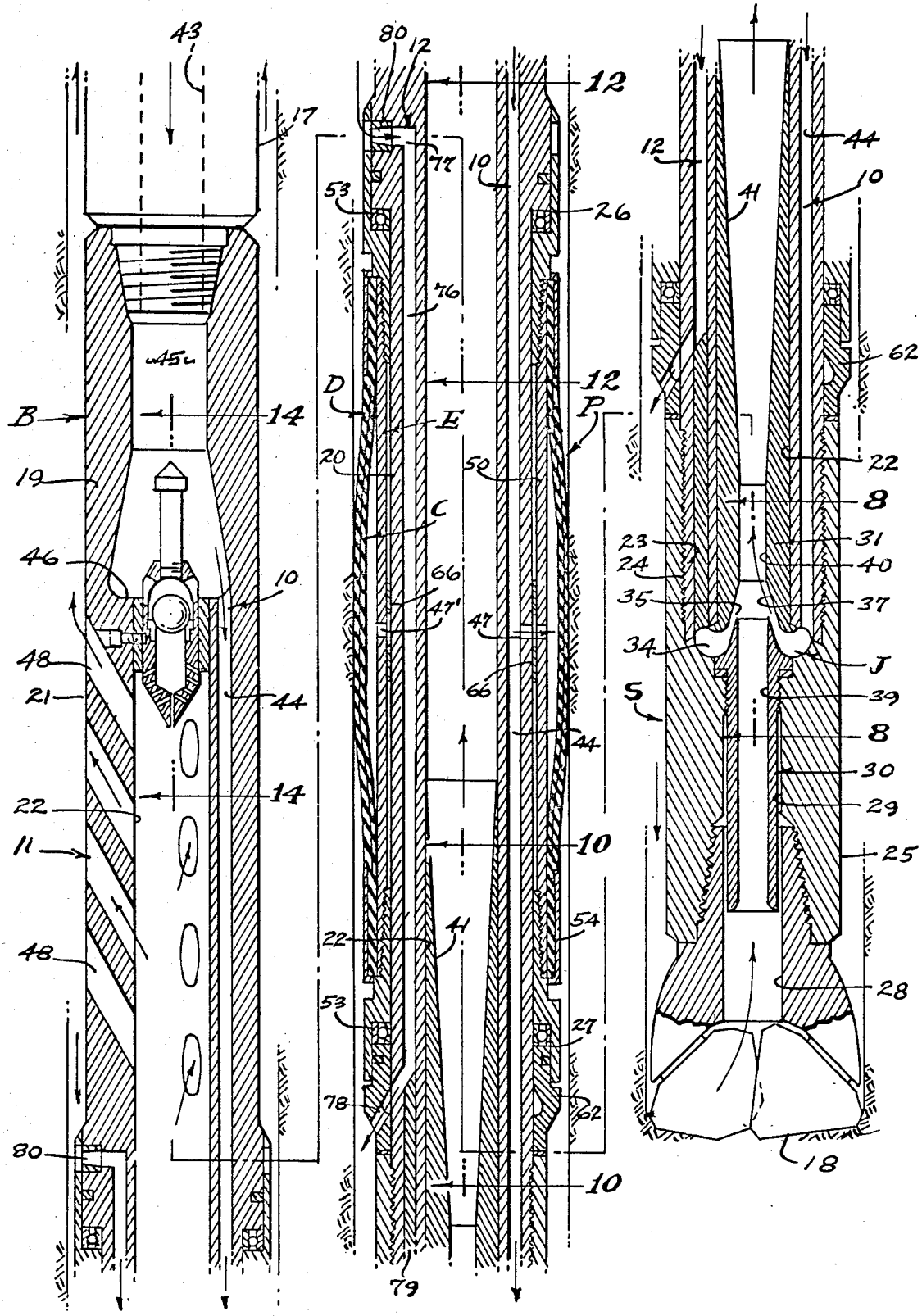
FIG. 7 is an enlarged longitudinal sectional view of the FIG. 3 embodiment.

Referring now to the drawings, this invention relates to a pressure differential tool, method and apparatus for differential pressure oilwell drilling. The tool involved is primarily a plug-stabilizer and jet pump and bit combination that continuously makes hole. The jet pump is controllably operated by varying pressure of the circulating fluid so as to establish differential pressure below and above the plug-stabilizer. Alternately, the drill string can remain fixed and a hydraulic mud motor on the like is operated to rotate the drill bit (not shown). This pressure differential tool can be a separate item of manufacture, or it can be incorporated in a drill bit, or in a sub, or in a drill collar or like tool as shown herein. Generally, this pressure differential tool, method and apparatus, for deep well drilling involves the controlled reduction of fluid pressure in the drilling zone. The pressure differential is substantial and is made significantly possible by a flow restrictive plug positioned immediately above the bit, and by providing pump means to establish suction from said drilling zone and with discharge up the well bore. It is significant herein that said plug-stabilizer provides a barrier so that the hydrostatic head of fluid in the well bore annulus above the plug and within the well bore is substantially isolated from the said drilling zone. In practice, the plug is controllably expanded to substantially occupy the well bore annulus with freedom for downward movement during the drilling operation, and also with downward leakage of the annulus fluid restricted.

A controlled proportion of circulating fluid can be shared between the said pump and the jets of the drilling bit, and a feature is that the plug-stabilizer closure is slideable in the well bore as penetration progresses with pressure differential control by means of fluid pressure applied by surface mud pumps. In accordance with this invention, the pump means is a jet pump that lifts a greater volume of fluid than that required for its operation, the mud pump pressure being controllably applied to reduce the drilling zone pressure as circumstances require. Therefore, reduced drilling zone pressures are established so that the formation pore pressure aids in the rate of penetration, while the hydrostatic head is isolated above the plug-stabilizer for well bore integrity.

In accordance with this invention, I provide a well drilling tool that substantially closes the well bore immediately above the drilling bit, by means of a controllably expansible plug-stablilizer. The plug expansion is proximate to the well bore wall so that said plug is slideably engageable therein and functions as a stabilizer, while controlled downward leakage of annulus fluid occurs. This annulus bypass of well fluid under static head pressure is shown throughout the drawings, and is controlled by mud pump pressure applied to a jet pump that establishes an underbalanced pressure condition beneath the plug-stabilizer and only throughout the drilling zone. This basic operational concept is best illustrated in FIG. 2 of the drawings wherein the tool is characterized by the internal bypass of mud to the jet pump, and by the bypass of upwardly flowing circulating fluid and chips into the well bore annulus for discharge up the hole.

Five embodiments of this method and apparatus are shown in FIGS. 2 through 6 of the drawings, the basic concept being shown by FIG. 2 which diagrams the flow patterns of circulating mud to the jet pump J and up the well bore annulus. Characteristically, the pumped pressure of the circulating fluid acts to expand a plug-stabilizer P to substantially close the well bore annulus while permitting annulus bypass of annulus fluid to lubricate the plug-stabilizer and to act as flushing fluid around the drill bit. This annulus bypass downwardly around the plug-stabilizer P is characteristic of all forms of this tool. In all forms of this tool in FIGS. 2–6 there is an internal bypass means 10 to circulate mud under pump pressure from the drill pipe to the jet pump J, and there is an internal and upward bypass means 11 to discharge upwardly flowing circulating fluid and chips into the well bore annulus above the tool. In FIGS. 2–4 the drill bit is of the center discharge type that receives flushing fluid from the well bore annulus. In the preferred form of FIG. 3 there is an internal and downward bypass means 12 for supplying supplemental flushing fluid under static head pressure from the well bore annulus above the plug-stabilizer P to the well bore annulus below the plug-stabilizer P. Alternately in the form of FIG. 4 the supply of supplemental flushing fluid is through a mud pressure bypass means 13, from the drill pipe to the well bore annulus below the plug-stabilizer P. The form of FIG. 5 provides for the use of conventional jet drill bits, in which case mud pump pressure to the jet pump J is shared through bypass means 14 with the bit jets at 15, there being an annulus bypass means 16 around the bit and to the jet pump J. In FIG. 6 a form of tool is shown that includes the bypass means 12 and the bypass means 14 and the bypass means 16, all as above described. It is the modulated annulus bypass around the plug-stabilizer P that controls the pressure differential operation of this tool and method of well drilling.

Figure 8:
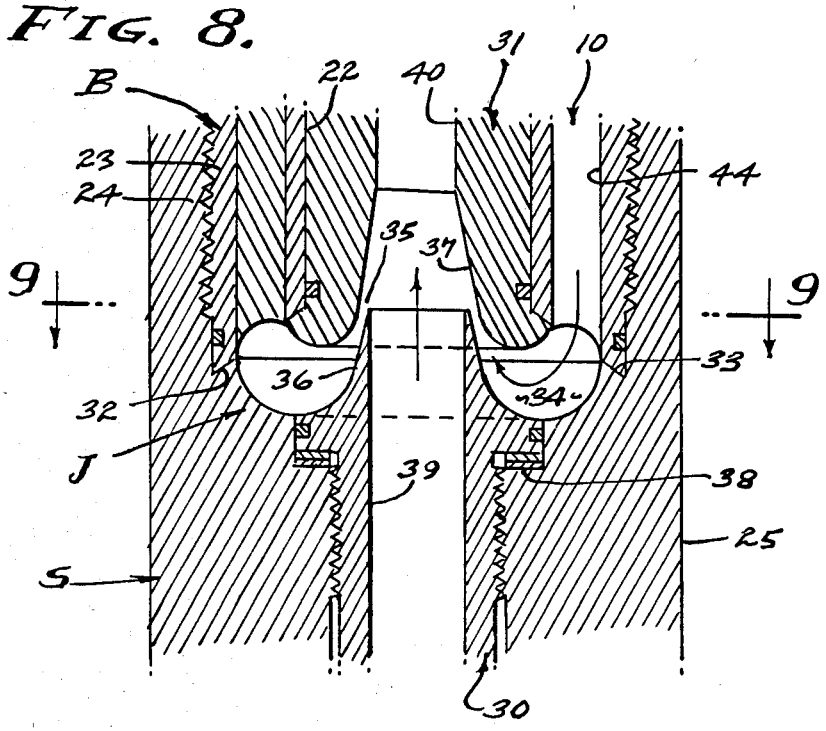
FIG. 8 is an enlarged fragmentary view taken as indicated by line 8—8 on FIG. 7.
Figure 9:
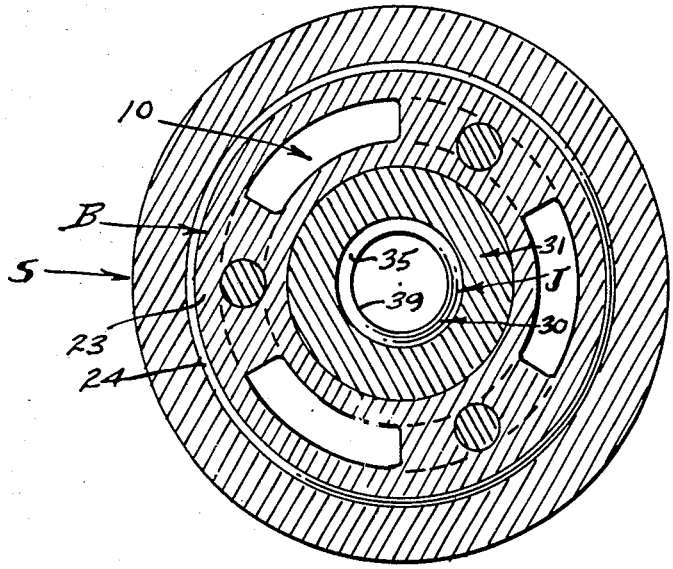
FIG. 9 is a transverse sectional view taken as indicated by line 9—9 on FIG. 8.

Referring now to the preferred embodiment of FIGS. 3 and 7 and related figures, the basic tool involves generally a body B coupled to the drill string 17 and carrying the plug-stabilizer P, and a sub-body S mounting the drill bit 18. The aforementioned jet pump J, the internal bypass means 10, and the annulus bypass means 11 are integrated therein, using a center discharge bit 18 as shown in FIGS. 3 and 7. Additionally, the internal and downward bypass means 12 is included as shown in FIGS. 3 and 7. The tool is characterized by the peripheral nozzle jet pump J as best shown in FIGS. 8 and 9, and by the bore annulus modulating plug-stabilizer P, as will be described.

The body B can be fabricated in sections and is shown as integrally formed of upper and lower sections 19 and 20. The upper body section 19 couples to the drill string 17 and incorporates the internal and upward bypass means 11 while the lower body section 20 rotatably carriers the modulating plug-stabilizer P and the sub-body S with the drill bit 18. Both body sections incorporate the internal bypass means 10 for directing circulating fluid under pressure to the jet pump J. The upper body section 19 is of tubular cylinder form having an outside diameter wall 21 corresponding to the coupling box diameter of the drill string pipe 17, and having an inner diameter wall 22 corresponding to the discharge diameter of the jet pump J. The inner diameter wall 22 continues into the lower body section 20 where the jet pump J is located.

The sub-body S is secured to the lower reduced diameter portion 23 of the body 20 by means of a threaded connection 24, the sub-body having an outside diameter wall 25 also corresponding to the coupling box diameter of the drill string pipe 17 and to the wall 21 of body section 19. As shown, the lower body section 20 is of reduced diameter as it extends between opposed shoulders 26 and 27, and between which the plug-stabilizer P operates. As shown in FIG. 7, the drill bit 18 pin is threaded into the sub-body S, and the bit is of the center discharge type having a bore 28 therethrough to open from the bottom of the well bore and through the pin, thereby communicating with a center bore 29 through the sub body.

In accordance with this invention, I provide a peripheral nozzle jet pump J in open communication with the center bore 29 of the sub-body S and discharging openly into the bore of body B as defined by the inner diameter wall 22. The jet pump J is comprised of features formed in or carried by the joinder of the body B and sub-body S, and preferably by replaceable members in the form of an inlet tube 30 and a discharge diffuser 31 captured by making up the threaded connection 24. The lower terminal end 32 of body section 20 is engaged with a shoulder 33 of the sub-body S, the end 32 and shoulder 33 being upwardly and inwardly chamfered with the end chamfer continuing to the inner diameter wall 22 where said wall terminates. Shoulder 33 is of limited inward extent, the sub-body S being chambered to form an annular plenum 34 in communication with the bypass 10 as later described. The inlet tube 30 is centered within the tool and is carried by the sub-body S, threaded thereto as shown in FIGS. 7 and 8. The diffuser 31 is coaxial with the tube 30 and is also centered in the tool and carried by the body B, and pressed therein as shown in FIGS. 7 and 8.

In accordance with this invention, a peripheral nozzle 35 is formed by the axial opposition of the inlet tube 30 and diffuser 31. Accordingly, the members 30 and 31 are axially spaced, the inlet tube member 30 having a conical upwardly convergent exterior wall 36, and the diffuser member 31 having a conical upwardly convergent interior wall 37. In practice, the conical angles of the walls 36 and 37 are the same, being adjustably spaced as by shims 38. As shown, the exterior conical wall 36 terminates at a sharp peripheral lip where the bore 39 of tube 30 is terminated, and the conical interior wall 37 of diffuser 31 merges obtusely with the bore 40 or throat of the diffuser member 31. The bores 39 and 40 of the jet pump members 30 and 31 are of substantially the same diameter, as shown. In practice however, the bore 40 is only slightly smaller. A feature is the totally unobstructed flow through bores 39 and 40, and the coextensively annular peripheral nozzle 35, by which the jet pump J efficiently entrains chip laden fluid mud from the bore 29 and bit bore 28. As shown, the inlet tube 30 extends into the bore 28 for the reception of chip laden fluid, members 30 and 31 being made of hard wear resistant material. The jet pump bores 39 and 40 are necessarily of restricted diameter as shown, in order to function, and substantially smaller in diameter than the body wall 22. Therefore, the diffuser 31 has a gradually divergent conical bore opening upwardly into the interior of the body B for subsequent dishcarge into the well bore annulus surrounding the tool.

Figure 11:
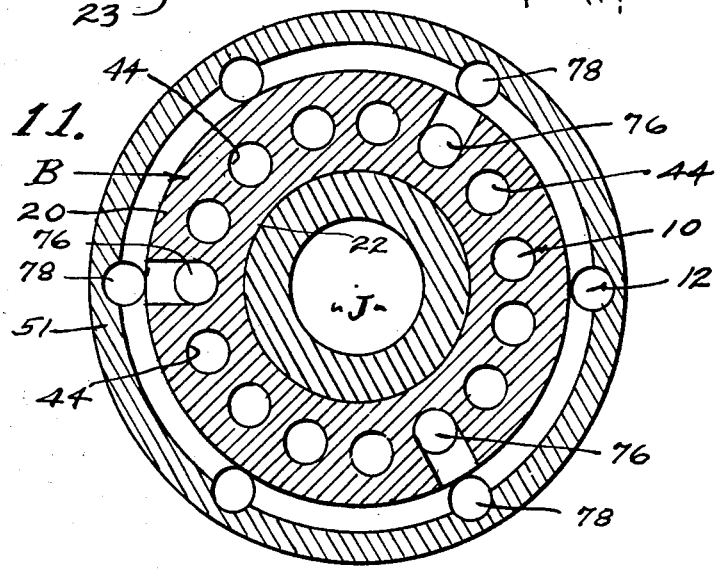
FIG. 11 is a transverse sectional view taken as indicated by line 11—11 on FIG. 10.
Figure 13:
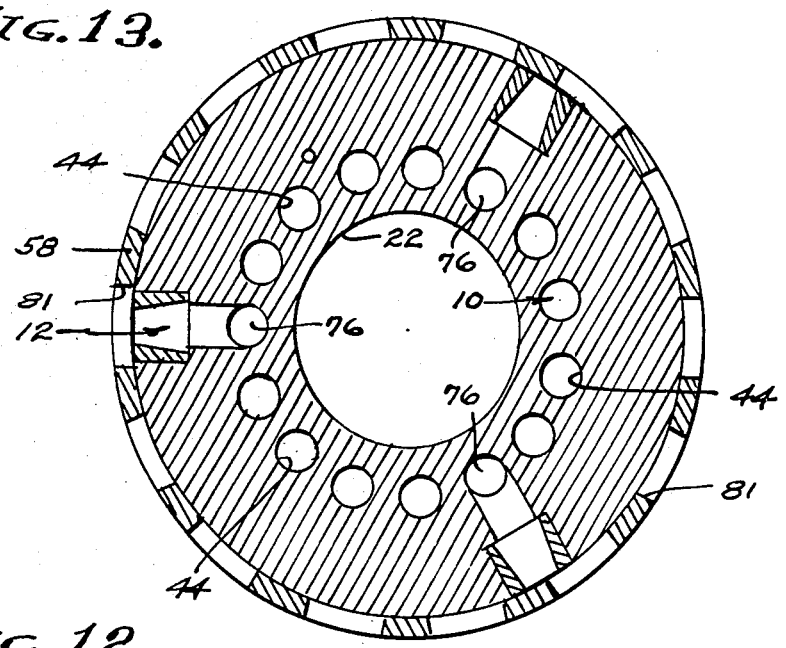
FIG. 13 is a transverse sectional view taken as indicated by line 13—13 on FIG. 12.

Referring now to the internal bypass means 10, it will be seen from FIG. 7 that the bore 43 of the drill string pipe 17 is in open communication with the plenum 34 of the jet pump J via one or more and preferably a plurality of passages 44 through the walls of body sections 19 and 20. As best illustrated in FIGS. 11 and 13 there are three groups of holes or passages 44 that are gun-drilled through the body B, opening from a bore 45 therein separated from the wall 22 bore by a header 46. The passages 44 open into plenum 34 and deliver the mud pump fluid under pressure to the peripheral nozzle 35. There is also a lateral port 47 from one or more of the passages 44, distributing mud pump fluid pressure into the plug-stabilizer P for its controlled modulating effect upon the annulus bypass of fluid around the tool, as shown throughout the drawings.

Figure 15:
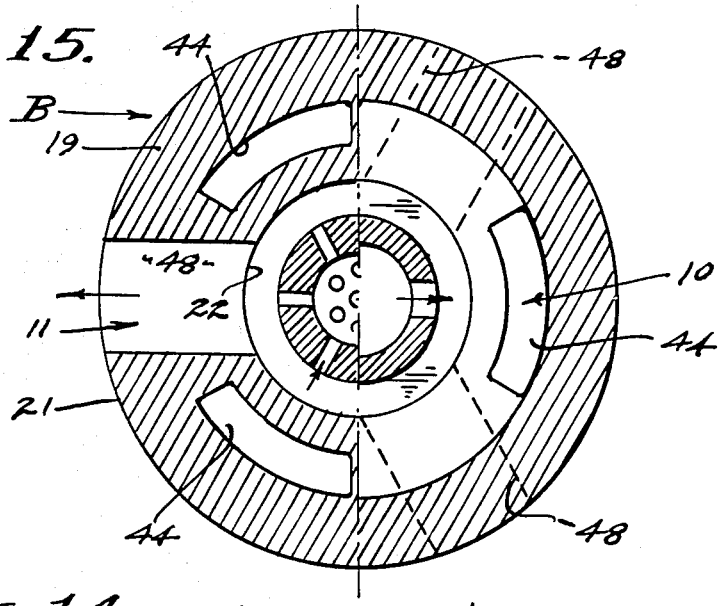
FIG. 15 is a transverse sectional view taken as indicated by line 15—15 on FIG. 14.
Figure 14:
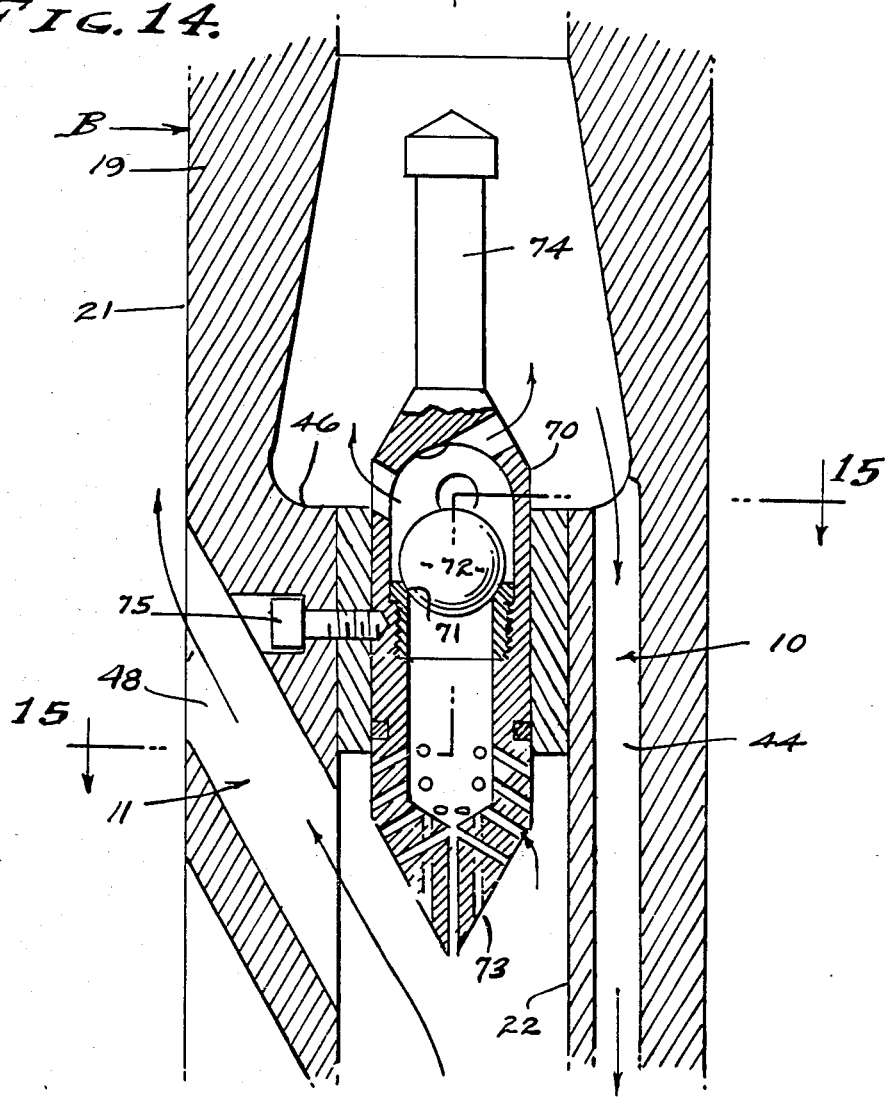
FIG. 14 is an enlarged fragmentary view taken as indicated by line 14—14 on FIG. 7.

Referring now to the internal and upward bypass means 11, it will be seen from FIG. 7 that the formation well bore annulus is in open communication with the discharge of the jet pump J via one or more and preferably a plurality of cross-over ports 48 through the wall of the body section 19. The ports 48 are disposed diagonally so as to discharge upwardly and outwardly into the well bore surrounding the tool above the lower body section 20 and above the plug-stabilizer P. As best illustrated in FIG. 15, each of the three groups of passages 44 are opened into a widened passage, and each group of passages or widened passage 44 is disposed between a pair of cross over ports 48. In this manner the flow circuits of bypass means 10 and 11 are separated.

In accordance with this invention, I provide a plug-stabilizer P operable over the lower body section 20 and below the discharge of chip laden mud from the cross-over ports 48. The plug-stabilizer P is a modulating device that controls the annulus bypass of static well bore fluid around the tool. It is the reduced pressure established in the drilling zone surrounding the drill bit 18 that is controlled, while drilling continues without interruption. To this end the plug-stabilizer is fabricated so as to have limited expansion that can be increased or decreased through the applied mud pump pressure. Accordingly, the plug-stabilizer is characterized by expansion limiting means L for limiting radial expansion of the plug-stabilizer responsive to fluid pressure. The controlled and expanded condition of the plug-stabilizer P is shown in FIGS. 2–6 and in FIG. 7, and the details of the preferred embodiment thereof are shown in FIGS. 10,12 and 16 through 27. As best illustrated in FIG. 17 the plug-stabilizer P is comprised generally of two prefabricated members, an expandable sleeve C and a wear boot D. The expansion limiting means L is carried within the boot D and is preferably in the form of barrel-like tension members or staves anchored to a bearing sleeve E at opposite ends. In practice, the staves have limited free movement at their anchored ends, whereby initial expansion of the boot is permitted, with additional expansion as a result of applied pressure controlled by the tensile strength of the staves and their modulus of elasticity.

Figure 16:
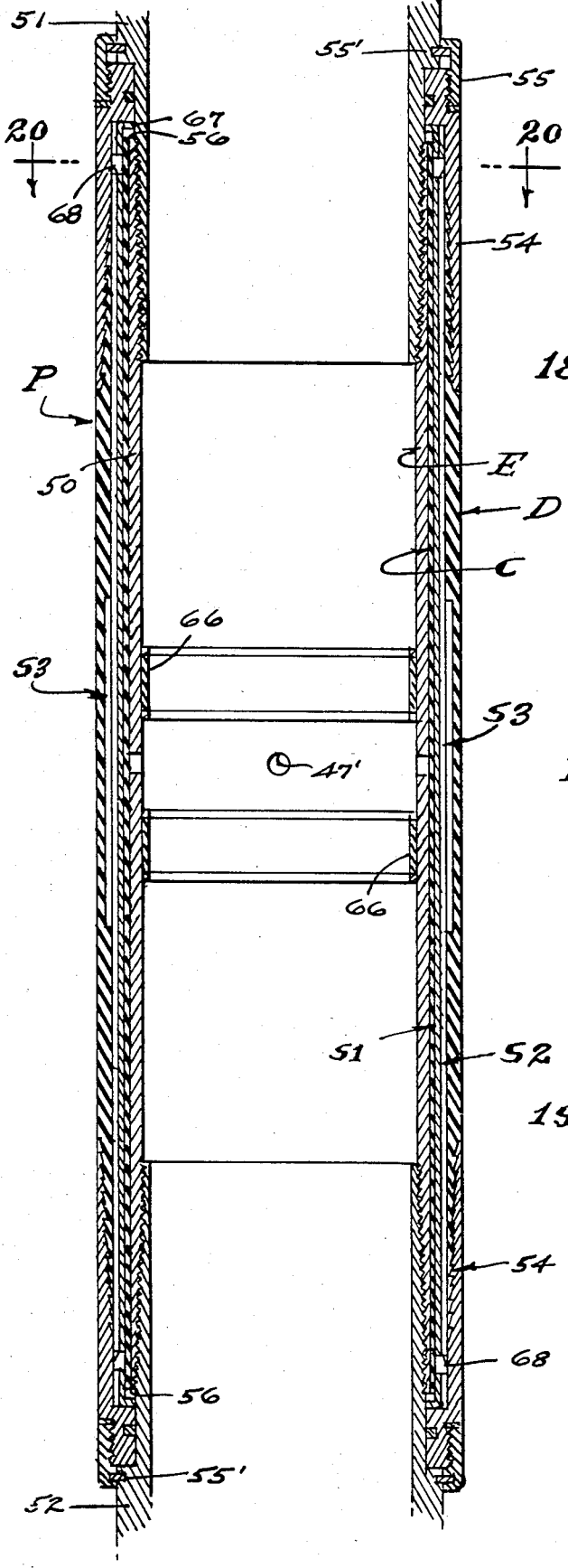
FIG. 16 is an enlarged longitudinal sectional view of the plug-stabilizer assembly as it appears removed from the body of the tool.
Figure 17:
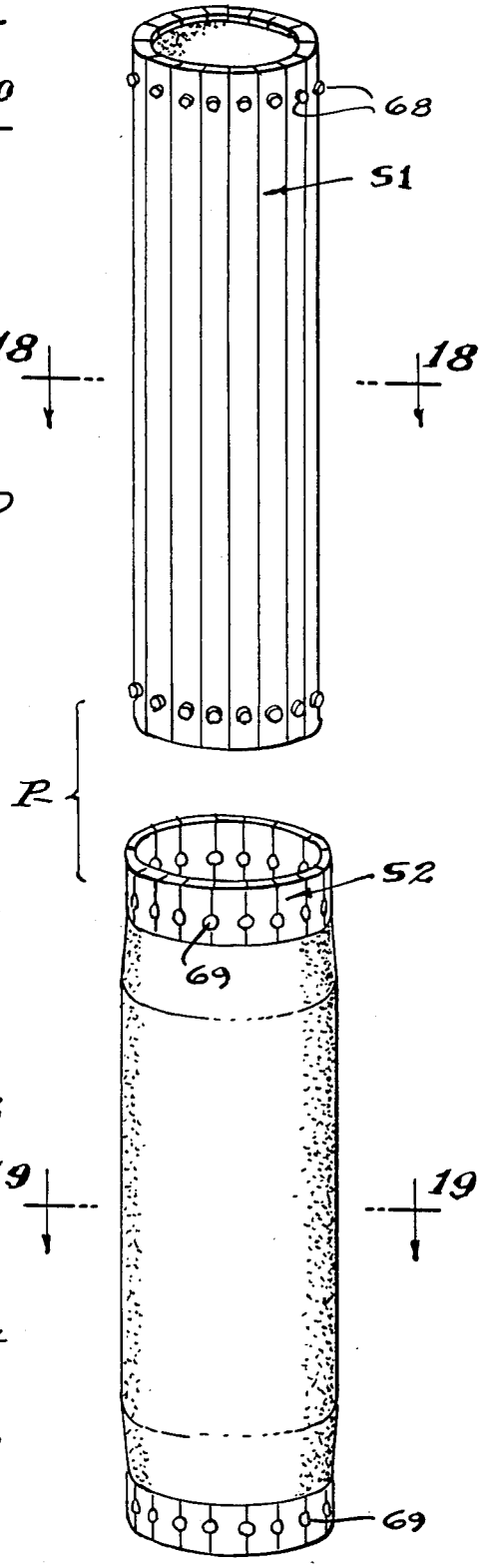
FIG. 17 is a perspective view of the two major fabrications that comprise the plug-stabilizer.

Referring now to FIG. 16, the plug-stabilizer P is a sub-assembly that is rotatably carried over the body B as shown in FIG. 7. In order to make up said sub-assembly, the bearing sleeve E is sectional and made up of a cylindrical body 50 with upper and lower end bearing collars 51 and 52 operable on anti-friction thrust bearings 53 positioned by the opposed body shoulders 26 and 27. The expandable sleeve C and wear boot D are secured at the collars 51 and 52 by anchor collars 54 and a nut 55. The assembly being made up as sequentially shown in FIGS. 23 through 27, with the expansion limiting means L captured in working position as will be described.

The cylinder body 50 is of uniform inner and outer diameters, carried with clearance over the reduced diameter portion 23 of the body B, and presents oppositely faced upper and lower end stop shoulders 56. Although the bearing collars differ as will be described, the assembly of the top and bottom ends of the plug-stabilizer are alike, as clearly shown. The bearing collars 51 and 52 are threaded in and into positioned engagement with the cylinder body 50 with an extending diameter exposing the stop shoulders 56 for engagement by the expansion limiting means L. The bearing collar 51 has a bearing seat 57 carried on a bearing 53, with an upwardly extending skirt 58 rotatable over the body B and sealed therewith at 59. The bearing collar 52 has a bearing seat 60 carried on a bearing 53 with a depending skirt 61 rotatable over the sub-body S or a separate extension 62 thereof as shown.

Figure 12:
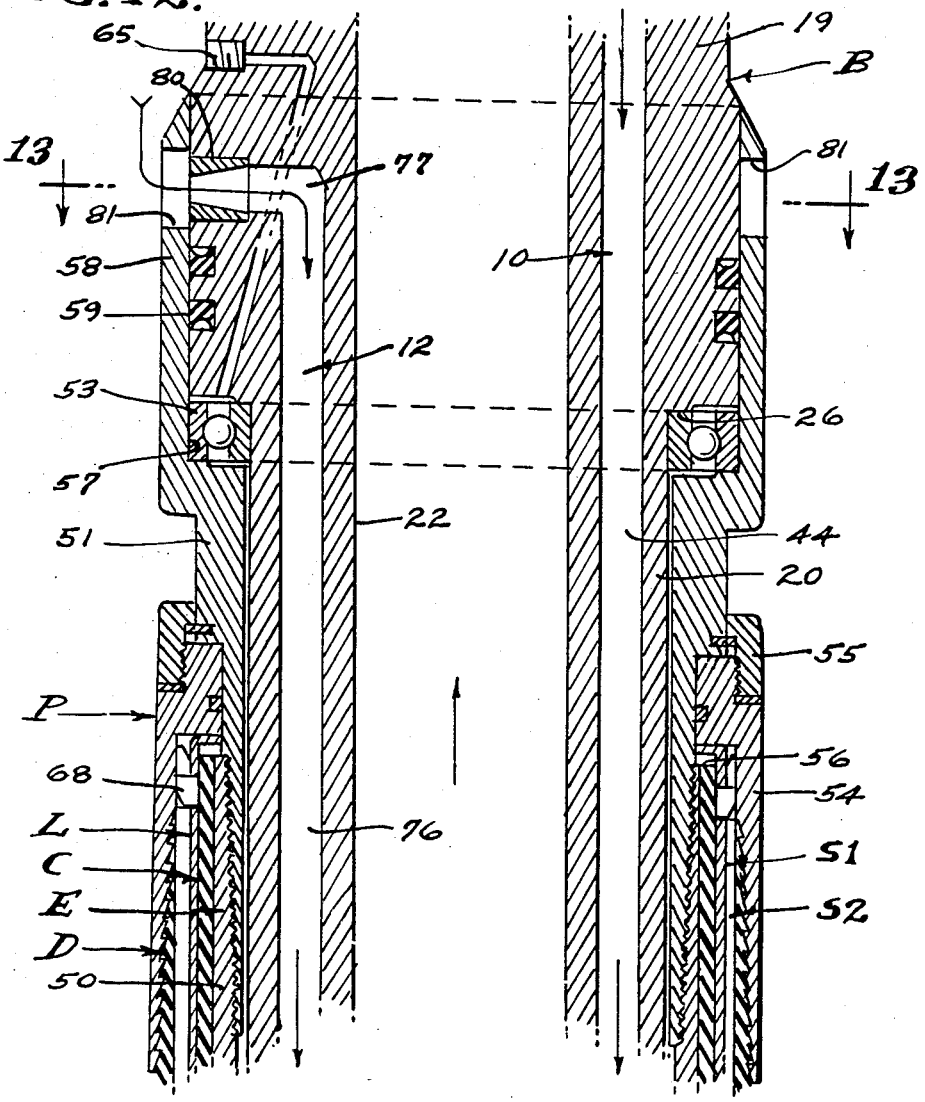
FIG. 12 is an enlarged fragmentary view taken as indicated by line 12—12 on FIG. 7.

The sub-body extension 62 is employed to facilitate manufacture, to incorporate features of the internal and downward bypass means 12, and to adjust the bearing pre-load with shims 63. The skirt 61 is sealed with the extension 62 at 64. Thus, the bearings are enclosed and can be pre-packed with lubricant through a plug 65 and passage as shown in FIG. 12, there being sliding seals 66 in the annulus between the body B and cylinder body 50, responsive to mud pump pressure, so as to lubricate the bearings.

Figure 18:
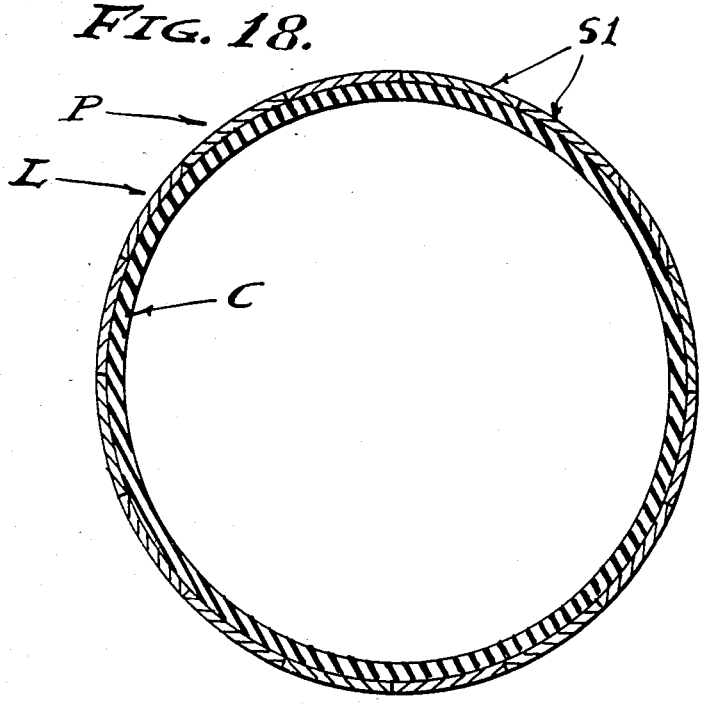
FIGS. 18 and 19 are enlarged sectional view taken as indicated by lines 18—18 and 19—19 on FIG. 17, and FIG. 20 by line 20—20 on FIG. 16.

In accordance with this invention, the rotatable bearing sleeve E is surrounded by the expandable sleeve C of elastic material, the expansion of which is controlled by the expansion limiting means L, as clearly shown in FIGS. 17 and 18. The fabrication of the expandable sleeve C and staves S1 is intended to be a permanent bonded assembly, whereas the fabrication of the wear boot D and staves S2 is to be expandable. This replaceable sleeve-like member is sealed with the outer diameter of the cylinder body 50 at the opposite top and bottom ends thereof and is exposed to mud pump fluid pressure via the port 47 and a complementary lateral port 47' through the wall of said cylinder body 50 (see FIG. 16). Accordingly, the expandable sleeve C is subject to inflation by said mud pump pressure.

In accordance with this invention, expansion of sleeve C is restricted and modulated by the expansion limiting means L which comprises at least one and preferably a plurality of tension members extending between the opposite top and bottom ends of the cylinder body 50. The tension members are referred to herein as staves S1 that lie circumferentially adjacent each other when relaxed and extending to the opposite top and bottom ends of the cylinder body 50. The staves S1 are initially formed as straight elongated tension members of arcuate concavo-convex cross section, separably fitted together in barrel formation (see FIG. 17). An even number of staves S1 is employed, so as to be anchored to the staves S2 later described and the anchorage of said opposite ends is achieved by inturned ears 67 engageable with the opposite end shoulders 56 of the cylinder body 50. Although the ears 67 can be simultaneously engaged with opposite shoulders 56, they are shown to be initially spaced therefrom, so as to provide limited free movement of the staves S1 to a nominal plug diameter before tension is applied to the staves. However, when the anchor ears 67 engage the stop shoulders 56, further expansion is predictable commensurate with the mud pump pressure applied. In this manner the effective diameter of the pug-stabilizer P is controlled as circumstances require.

Figure 10:
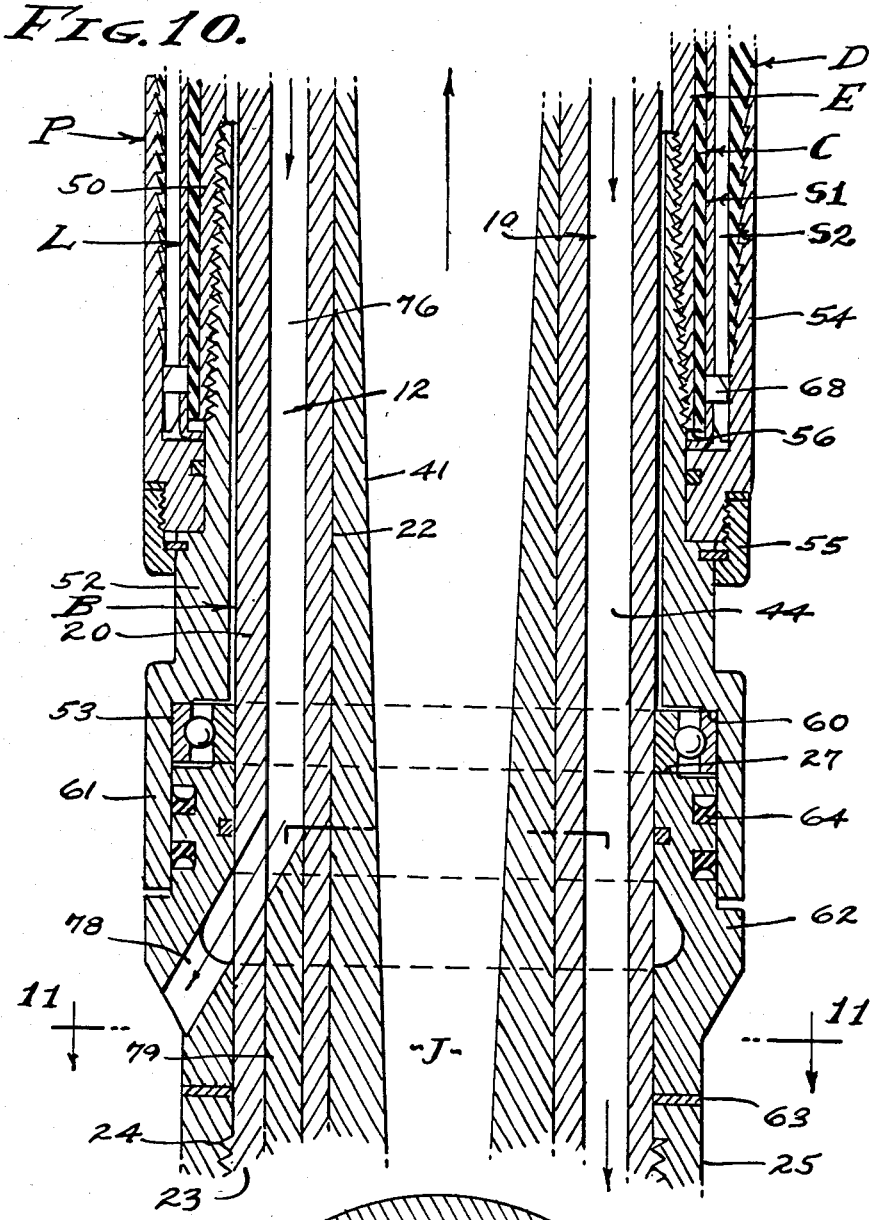
FIG. 10 is an enlarged fragmentary view taken as indicated by line 10—10 on FIG. 7.

In accordance with this invention, the wear boot D is not exposed to the mud pump pressure, and accordingly is a cylinder of wear resistant elastic material that surrounds the expansion limiting means L. The fabrication of the wear boot D and protective staves S2 is intended to be a replaceable assembly. The wear boot D tightly surrounds the barrel-like assembly of staves S1 and is anchored to the cylinder body 50 and bearing collars 51 and 52 by the anchor collars 54 positioned by the nuts 55. As shown in FIGS. 10 and 12 (25–27), the collars 54 have tapered and wickered threads that screw over and clamp the elastomeric body of boot D, thereby also clamping the underlying end portions of the elastomeric sleeve C. Accordingly, the opposite end portions of the expandable sleeve C and surrounding wear boot D are sealed with the cylinder body 50.

In accordance with this invention, the staves S2 are provided for isolation of the wear boot D from mud pump pressure, and to enhance the tension properties of the expansion limiting means L. The staves S2 are initially formed of straight elongated concavo-convex cross section, the assembly of which are separably fitted together in barrel formation (see FIG. 17) to become part of said expansion limiting means. That is, the staves S2 coact with the staves S1 to establish the means L, and the said staves are characteristically shingled or overlapped as clearly shown in FIG. 20, so that there is no direct rout for extrusion of the elastomer sleeve C, and so that boot D is not subject to internal hydraulic pressure.

Like the staves S1, the staves S2 also lie circumferentially adjacent each other when relaxed and extending to opposite top and bottom ends of the cylinder body 50, where they are anchored by pins 68. As shown, the edge portions of a pair of adjacent staves S2 are centered over each stave S1, the staves S1 and S2 being substantially coextensive from top to bottom. The anchor pins 68 are carried by the opposite end portions of the staves S1 and project therefrom radially a distance equal to the thickness of the staves S2. In practice, the staves S2, being at a slightly greater radius than the staves S1, are of greater thickness than staves S1 in order that the modulus of elasticity of the two staves S1 and S2 are compatable. The pins 68 are centered on the staves S1 and have anchored engagement with notches 69 in the opposite side edges of the staves S2 (see FIG. 22). Thus, the notches 69 of adjacent staves S2 are complementary to form a full diameter to receive pins 68, thereby securing staves S1 and S2 together as a composite tension assembly.

From the foregoing, it will be seen that the staves S1 and S2 are circumferentially slideable one with the other, so that radial expansion is not restricted by hoop-stress. However, the staves S1 and S2 are subject to tension stress that is designed to permit controlled radial expansion under control of the degree of internal mud pump pressure applied within the expandable sleeve C. Accordingly, the staves S1 and S2 will bow radially outward with a small or normal amount of operating mud pump pressure, until the ears 67 engage the stop shoulders 56 so as to establish a nominal working plug-stablizer P diameter. In practice, this nominal working diameter of plug-stabilizer P is just clear of or substantially the same diameter as the well bore. Therefore, the standing head pressure of the well bore fluid in the well bore annulus over the plug-stabilizer P tends to and will bypass the wear boot D during the well drilling operation, due to the decrease in annulus pressure below the wear boot D and in the drilling zone surrounding the drill bit 18. This decrease in drilling zone pressure is referred to herein as an underbalanced condition conducive to drilling efficiency, and is the result of the reduced pressure caused by the suction into the jet pump J. By controllably increasing the mud pump pressure from said normal operating pressure, the diameter of the plug-stabilizer P is modulated to control said bore annulus bypass as may be required.

Figure 19:
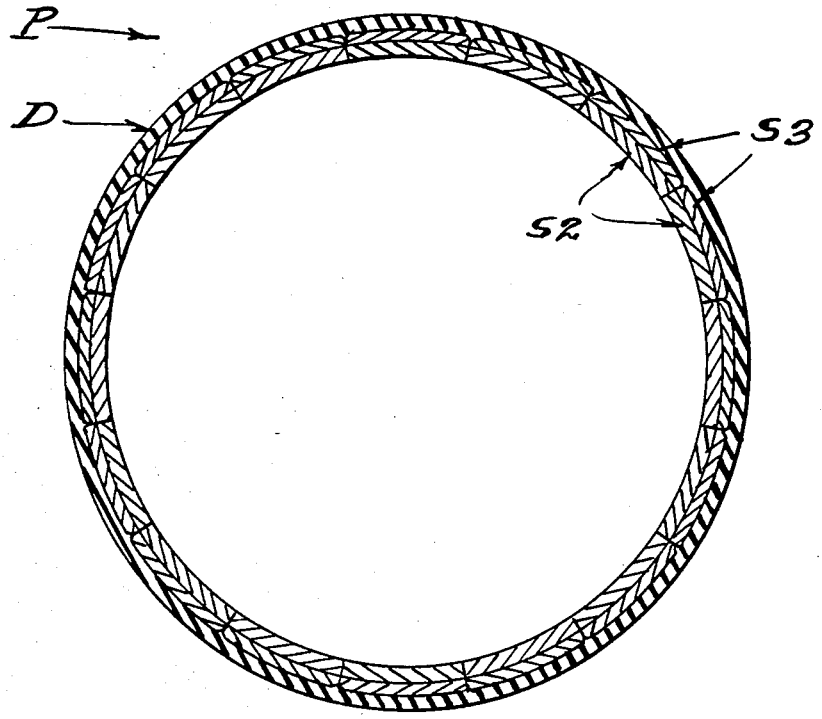
Figure 20:
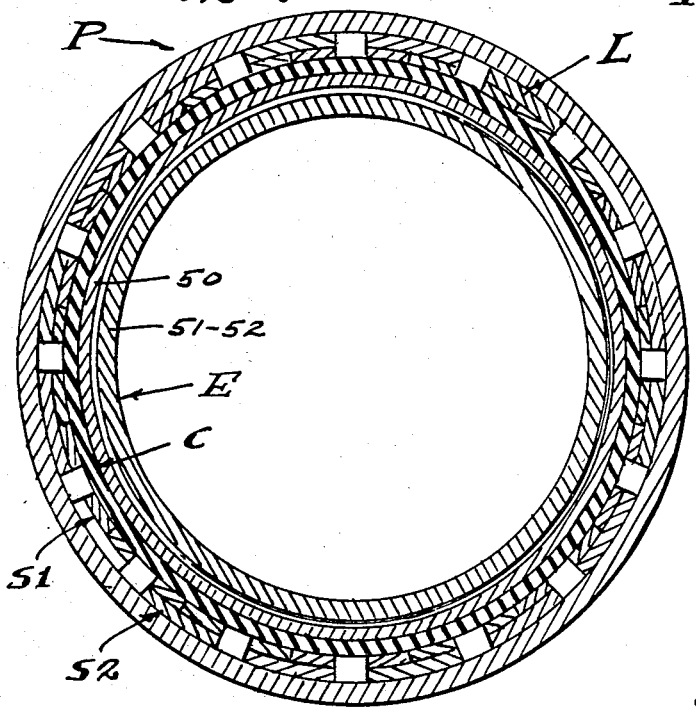
Figure 21:
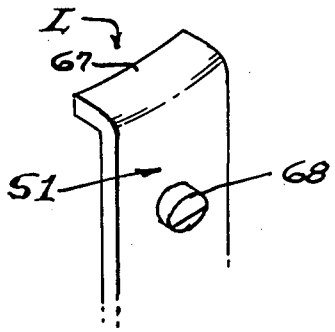
FIGS. 21 and 22 are fragmentary perspective views showing details of the plug-stabilizer assembly.
Figure 22:
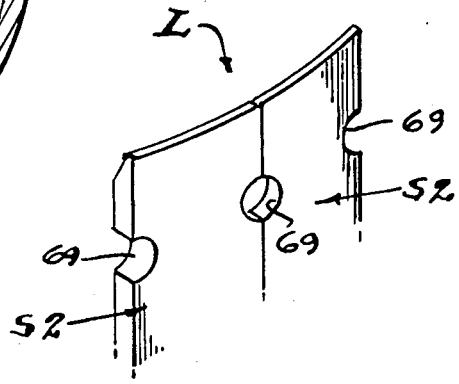
Figures 23, 24, 25, 26:
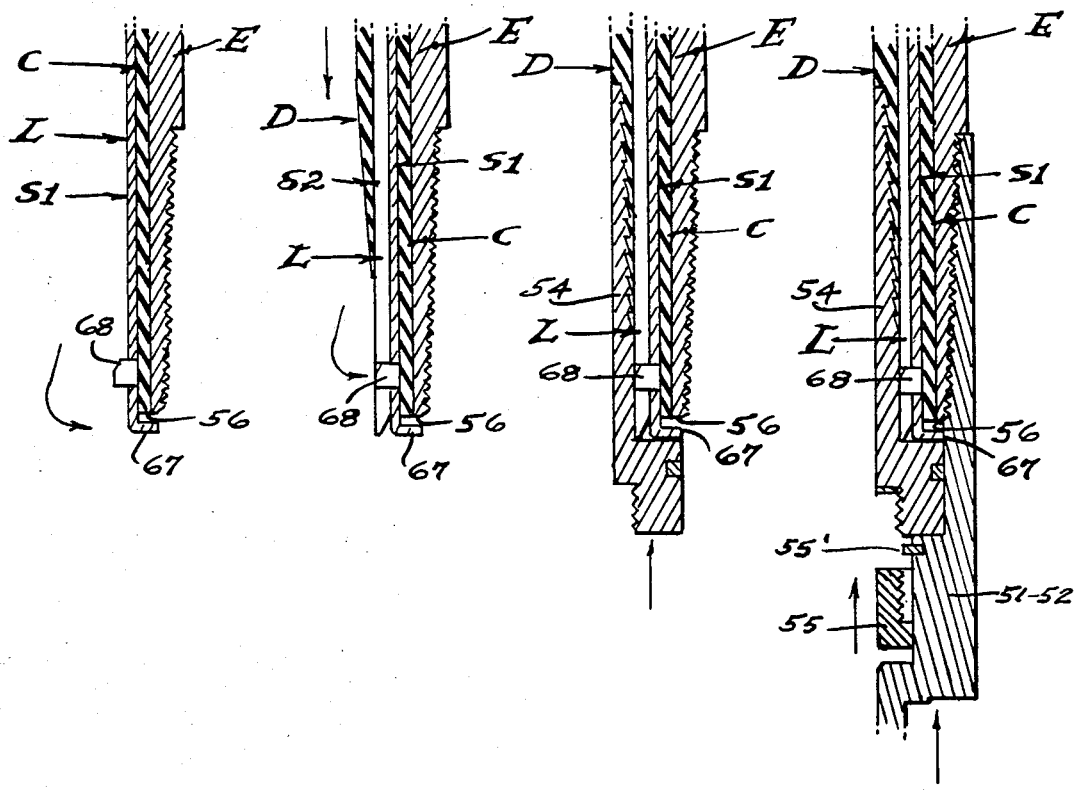
FIGS. 23 through 27 are fragmentary sectional view showing the steps of assembling the plug-stabilizer.
Figure 27:
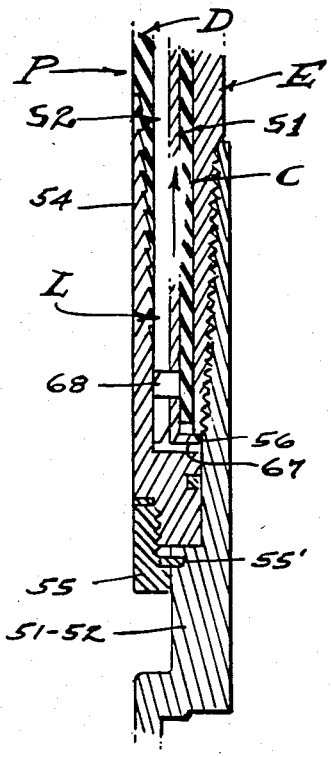

In accordance with this invention, the mid portion of the plug-stabilizer P is made to be more or less cylindrical in form, and to this end I provide staves S3 that reinforce the mid portion of the wear boot D, as shown in FIGS. 16 and 19. As is indicated in FIGS. 2–6 and in FIG. 7, the wear boot D of the plug-stabilizer P has an elongated mid portion of cylinder form, while the upper and lower end portions bow outwardly as mud pump pressure is applied. In practice, the staves S3 are straight elongated concavo-convex stiffeners of substantial cross section so as to reduce bowing of the mid section of the plug-stabilizer. In carrying out this invention, the staves S2 and S3 are permanently secured or welded together, and the assmebly thereof is permanently bonded to the surrounding wear boot D. Likewise, the staves S1 are permanently bonded to the lining or expandable sleeve C.

Assembly of the body B and sub-body S will be apparent from the foregoing description. However, the assembly of the plug-stabilizer P is unique and requires explanation. Referring now to FIGS. 23–27, the steps necessary for assembly of the plug-stabilizer P are shown, the top and bottom of the assembly being the same. Step one FIG. 23 requires constriction of the expandable sleeve C onto the cylinder body 50 of the bearing sleeve E; accomplished by sliding one over the other while stretching the ears 67 (and the elastomer) over the exterior of the cylinder body 50. Step two FIG. 24 requires constriction of the wear boot D onto the expandable sleeve C; accomplished by sliding one over the other while stretching the staves S2 (and the elastomer) over the pins 68. Note that the ends of the staves S2 and the tops of the pins 68 have complementary chamfers to facilitate this operation. Step three FIG. 25 requires clamping of the wear boot D and sealing of the expandable sleeve C; accomplished by screwing on the wickered threads of the anchor collar 54 until a shoulder of the collar touches with the anchor ears 67 of the primary staves S1. Step four FIG. 26 requires the installation of bearing collars 51–52, accomplished by threading said collar into the top and bottom inner end portions of the cylinder body 50, until seated against the outer end face of the anchor collar 54. Step 5 FIG. 27 requires securement of the anchor collars 54 to ensure free play of the anchor ears 67 for radial retraction of the modulating plug-stabilizer P; accomplished by threadedly engaging the nut 55 onto the collar 54, said nut being positioned by a snap ring 55'. Assembled as described, and with the seals 66 in place as shown, the plug-stabilizer P is engaged over the reduced diameter portion 23 of the body 20, and rotatably positioned on the bearings 53. Coupled engagement of the sub-body S and/or extension 62 thereof completes the installation.

A removeable plug and reverse flow check valve V is provided at the header 46, to facilitate lowering of the drill string and tool into the well bore by permitting the well fluid to bypass through the tool. The valve body is a cage 70 that carries a seat 71 on which a ball valve 72 rests during pump pressure operation. The cage is characterized by strainer ports 73 exposed to the bore of the inner diameter wall 22, so that fluid within the tool is bypassed into the drill pipe bore 43. The cage 70 has a headed stem 74 for engagement and withdrawal, by shearing a screw pin 75.

The basic annulus bypass peripheral nozzle drilling tool is diagramed in FIG. 2 to show the flow patterns thereof, including the internal bypass means 10 and the annulus bypass mans 11 in combination with the plug-stabilizer P and a center discharge bit 18.

A second embodiment comprised of said basic tool is diagramed in FIG. 3, and includes therein the internal and downward bypass means 12 as now described: Referring to FIG. 7 (left side of the center section) a passage 76 of the bypass means 12 will be seen to enter the body of the tool from the well bore annulus above the plug-stabilizer P, and to discharge from the extension 62 (or sub-body S) below the plug-stabilizer and into the drilling zone surrounding the drill bit 18. As shown in FIGS. 11 and 13, there are three circumferentially spaced passages 76 extending longitudinally through the side wall of the tool body section 20, each with a lateral inlet port 77 at the top end, and a lateral outlet port 78 at the lower end. In practice, the passages 76 are gun-drilled from the bottom of section 20, and plugged at 79 below the port 78. Inlet of annulus fluid into passage 76 is through a flow restrictive bean 80 with a divergent down-stream orifice (see FIG. 12). The bean 80 opens at an interface within the skirt 58, the skirt being provided with a circumferential series of cutter openings 81 to cut up any debris that might accumulate over the bean. Outlet of passage fluid is through ports 78 in the extension 62 communicating with lateral openings of the passages 76 via a collector chamber within the extension that surrounds the body section 20 (see FIG. 10). The bypass means 12 thus provides a controlled supply of well fluid from the standing head thereof in the well bore annulus and into the drilling zone surrounding the drill bit.

Figure 28:
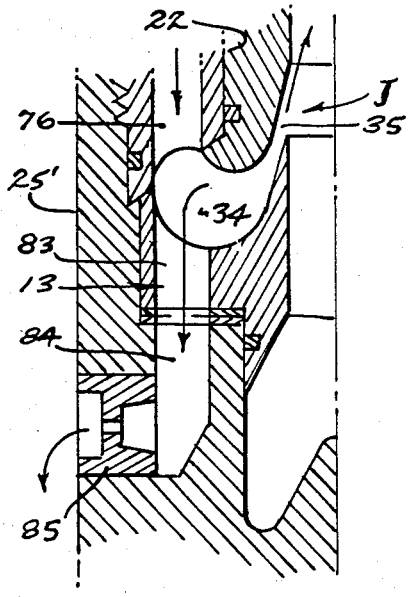
FIG. 28 is an enlarged fragmentary view of a portion of the tool similar to FIG. 8, showing the embodiment of FIG. 4.

A third embodiment comprised of said basic tool is diagramed in FIG. 4 and includes therein the mud pressure bypass means 13 as now described: Referring to FIG. 28 the source of circulating fluid to the drilling zone is from the passage or passages 76 that deliver mud pump pressure to the jet pump J. As shown, the annular plenum 34 of the jet pump is ported at 82 to communicate with discharge ports 84 opening laterally into the drilling zone below the plug-stabilizer P. Control of the bypass discharge is by means of a bean 85 restricting the mud flow as required. The mud pressure bypass means 13 thus provides a controlled supply of well fluid from the drill pipe bore 43 and into the drilling zone surrounding the drill bit.

Figure 29:
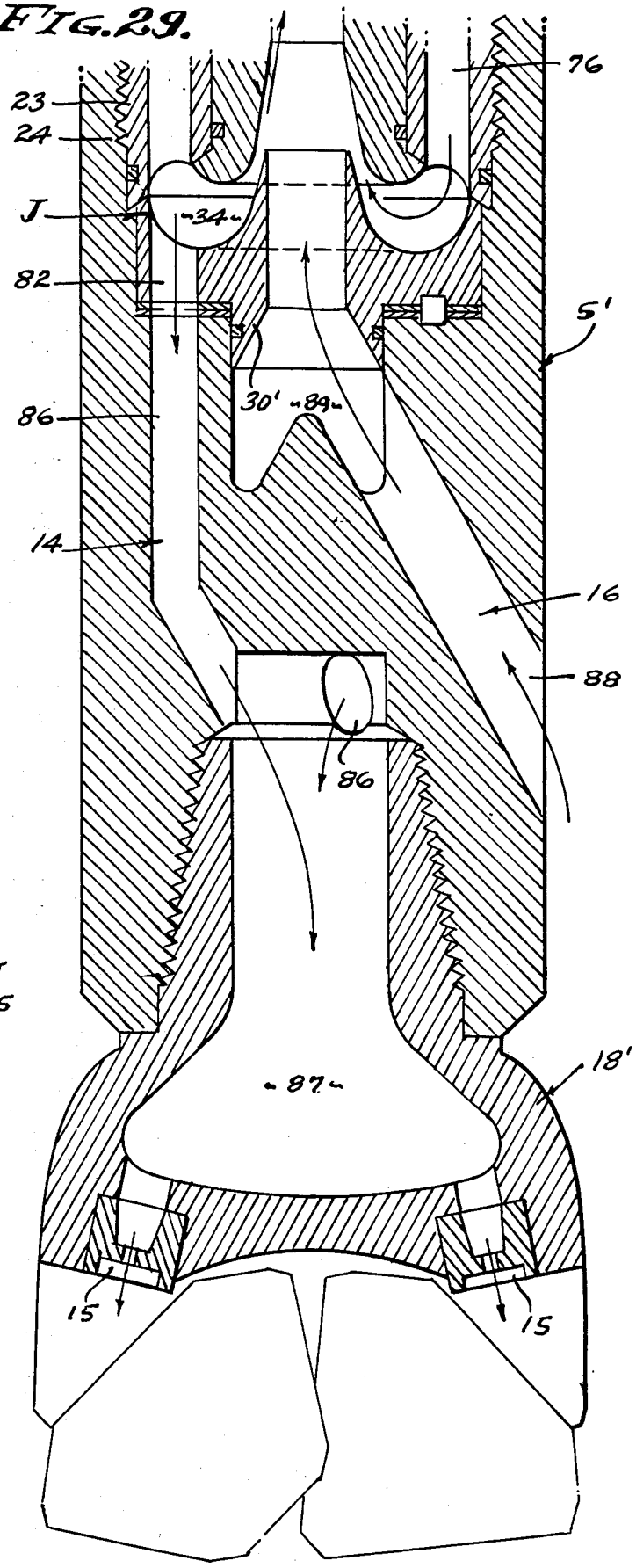
FIG. 29 is an enlarged longitudinal sectional view similar to the lowermost portion of FIG. 7, showing the embodiment of FIG. 5.

A fourth embodiment comprised of said basic tool is diagramed in FIG. 5 and includes therein the bypass means 14 sharing mud pump pressure and the annulus bypass means 16 around the bit in combination with a conventional jet bit as now described: Referring to FIG. 29 the source of circulating fluid to the bit jets 15 and to the drilling zone is from the passage or passages 76 that deliver mud pump pressure to the jet pump J. As shown, the bypass means 14 involves the annular plenum 34 of the jet pump and includes the ports at 82 to communicate with one or more passages 86 through the sub-body S' and opening into the pin of the jet bit 18'. The bit body has a plenum 87 that receives the mud and distributes it to the jets 15. The annulus bypass means 16 is a cross-over passage 88 into a suction plenum 89 that opens into the inlet tube 30' of the jet pump J. Accordingly, there is conventional flow through the jet bit 18', discharging circulating fluid from the jets 15 and into the jet pump J, with the result that drilling zone pressure is reduced and/or underbalanced below the plug-stabilizer P. The mud pump bypass means 14 provides a controlled supply of well fluid from the drill pipe bore 43 and into the drilling zone surrounding the bit, to be directed through the cross-over annulus bypass means 16 and into the jet pump for discharge above the plug-stabilizer P.

A fifth embodiment of said basic tool is diagramed in FIG. 6 and includes therein the internal and downward bypass means 12, the mud pump bypass means 14 and the annulus bypass means 16 all as hereinabove described, and in combination with a conventional jet bit 18' as shown in FIG. 29. This fifth form is essentially the same as the fourth form, however it includes the internal bypass means 12 to augment the well fluid supply to the drilling zone, whereby the dynamics of the jet pump J is increased.

The method of drilling as it is disclosed herein is an improvement over the long established rotary drilling method wherein circulating mud laden well fluid is discharged at the bit to flow upwardly in the well bore annulus surrounding the drill string. Both the weight and pressure of the well fluid are factors in establishing the balance of fluid pressure at the drilling zone with respect to the formation pore pressure. With the present invention there is control over the drilling zone pressure afforded by the plug-stabilizer P that isolates a drilling zone and is modulated in response to mud pump pressure to increase or decrease the downward annulus bypass of circulating fluid standing in the well bore annulus. This valve function is coordinated with the jet pump suction that decreases pressure in the drilling zone, whereby an underbalanced condition is established for increasing the rate of bit penetration as may be required. A primary advantage and characteristic feature of the plug-stabilizer P is that it does not set to the well bore, nor does it restrict the downward movement and penetration of the drill bit. The plug-stabilizer P remains free of the well bore, and the peripheral jet pump J is unobstructed for the free flow of chip laden mud therethrough.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A pressure differential drilling tool for reducing circulating fluid pressure in a drilling zone at the bit-to-bore bottom interface of a drill bit operated by a drilling string to continuously make hole in a well bore and including;

a body coupled to the lower end of the drilling string and carrying the drill bit for bit-to-bore bottom engagement and conducting circulating fluid under pressure and for removing formation chips from the bore bottom, a pressure expandable plug-stabilizer rotatably surrounding the body on bearings to advance downhole therewith and having expansion limiting means restricting the plug-stabilizer to less than the diameter of the well bore for free sliding engagement therein withing a controlled annulus bypass of circulating fluid between the plug-stabilizer and the surround well bore and standing under pressure in the well bore annulus above the plug-stabilizer and isolated from said drilling zone below the plug-stabilizer, and a jet pump with a suction tube open from said drilling zone and a diffuser open into the well bore above the plug-stabilizer and having a flow restricting nozzle sharing the flow of circulating fluid under pressure with a port opening within the plug-stabilizer to expand and modulate the diameter of the same while ejecting the chip laden circulating fluid and significantly reducing the pressure thereof within the drilling zone.

2. The pressure differential drilling tool as set forth in claim 1, wherein the body is sectional with an upper section coupled to the lower end of the drilling string and having cross-over ports from the jet pump diffuser to the well bore annulus above the plug-stabilizer, and with a lower section rotatably carrying the plug-stabilizer.

3. The pressure differential drilling tool as set forth in claim 2, wherein the discharge from the jet pump diffuser and through the cross-over ports is separated from the circulating fluid supply of the drilling string by a header in the body of the tool, there being a removeable plug and reverse flow check valve in said header to upwardly bypass well fluid through the tool when lowering the drilling string, and for removal in emergencies.

4. The pressure differential drilling tool as set forth in claim 1, wherein the body is sectional with a sub-body carrying the drill bit and coupled to said body and positioning the plug-stabilizer rotatably thereon.

5. The pressure differential drilling tool as set forth in claim 1, wherein the body is sectional with an upper section coupled to the lower end of the drilling string and having cross-over ports from the jet pump diffuser to the well bore annulus above the plug-stabilizer, with a lower section rotatably carrying the plug-stabilizer, and with a sub-body carrying the drill bit and coupled to the lower section of said body and positioning the plug-stabilizer rotatably thereon.

6. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is at least one tension member overlying the expandable sleeve and anchored to the upper and lower portions of the tubular body and subject to being stretched in response to the application of circulating fluid under controlled pressure thereby modulating the plug-stabilizer diameter.

7. The pressure differential drilling tool as set forth in claim 6, wherein an expandable wear boot surrounds the at least one tension member and expandable sleeve to slideably engage the well bore and modulating the annulus by controlled proximity thereto.

8. The pressure differential drilling tool as set forth in claim 7, wherein an expandable wear boot surrounds the secondary stave members to slideably engage the well bore and modulating the annulus by controlled proximity thereto.

9. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is a cage assembly of longitudinally disposed stave members surrounding the expandable sleeve and anchored to the upper and lower portions of the tubular body and subject to being stretched under tension in response to the application of circulating fluid under controlled pressure thereby modulating the plug-stabilizer diameter.

10. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is a cage assembly of separably adjacent longitudinally disposed stave members surrounding the expandable sleeve and anchored to the upper and lower portions of the tubular body and subject to being stretched under tension in response to the application of circulating fluid under controlled pressure thereby modulating the plug-stabilizer diameter.

11. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is a cage assembly surrounding the expandable sleeve and comprised of separably adjacent longitudinally disposed primary stave members contiguous to the expandable sleeve and of overlapping separably adjacent longitudinally disposed secondary stave members in circumferential sliding engagement over the primary stave members, said primary and secondary stave members being anchored to the upper and lower portions of the tubular body and subject to being stretched under tension in response to the application of circulating fluid under controlled pressure thereby modulating the plug-stabilizer diameter.

12. The pressure differential drilling tool as set forth in claim 1, wherein the plug-stabilizer is comprised of a tubular body having opposite end stop shoulders and carrying an expandable sleeve over said port opening therein and sealed with the upper and lower portions of the tubular body to be inflated by circulating fluid under pressure, and wherein the expansion limiting means is a cage assembly of longitudinally disposed stave members surrounding the expandable sleeve and having inwardly turned ears at their upper and lower ends engaging the opposite end stop shoulders to anchor the staves to the upper and lower portions of the tubular body and subject to being stretched under tension in response to the application of circulating fluid under controlled pressure thereby modulating the plug-stabilizer diameter.

13. The pressure differential drilling tool as set forth in claim 1, wherein the plug-stabilizer is comprised of a tubular body having opposite end stop shoulders and carrying an expandable sleeve over said port opening therein and sealed with the upper and lower portions of the tubular body to be inflated by circulating fluid under pressure, and wherein the expansion limiting means is a cage assembly of longitudinally disposed stave members surrounding the expandable sleeve and having inwardly turned ears at their upper and lower ends spaced from and engageable with the opposite stop shoulders to anchor the staves to the upper and lower portions of the tubular body for limiting the plug-stabilizer to a nominal expanded diameter subject to being stretched under tension in response to the application of circulating fluid under controlled pressure thereby modulating the plug-stabilizer diameter.

14. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is a cage assembly surrounding the expandable sleeve and comprised of separably adjacent longitudinally disposed primary stave members contiguous to the expandable sleeve and of overlapping separably adjacent longitudinally disposed secondary stave members in circumferential sliding engagement over the primary stave members, there being inwardly turned ears at the upper and lower ends of the stave members and spaced from and engageable with opposite stop shoulders at the upper and lower portions of the tubular body to anchor the staves subject to being stretched under tension in response to the application of circulating fluid under controlled pressure thereby modulating the plug-stabilizer diameter.

15. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is a cage assembly surrounding the expandable sleeve and comprised of separably adjacent longitudinally disposed primary stave members bonded to the expandable sleeve and of overlapping separably adjacent longitudinally disposed secondary stave members in circumferential sliding engagement over the primary stave members and bonded to a surrounding wear boot, there being inwardly turned ears at the upper and lower ends of the primary stave members and engaged with opposite stop shoulders at the upper and lower portions of the tubular body to anchor the staves and there being anchored engagement of the secondary stave members to the upper and lower end portions of the primary stave members, the primary and secondary stave members acting together subject to being stretched under tension in response to the application of circulating fluid under controlled pressure thereby modulating the plug-stabilizer diameter.

16. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is a cage assembly surrounding the expandable sleeve and comprised of separably adjacent longitudinally disposed primary stave members bonded to the expandable sleeve and of overlapping separably adjacent longitudinally disposed secondary stave members in circumferential sliding engagement over the primary stave members and bonded to a surrounding wear boot, there being inwardly turned ears at the upper and lower ends of the primary stave members and spaced from and engageable with opposite stop shoulders at the upper and lower portions of the tubular body to anchor the primary stave members for limiting the plug-stabilizer to a nominal expanded diameter, and there being there being anchored engagement of the secondary stave members to the upper and lower end portions of the primary stave members, the primary and secondary stave members acting together subject to being stretched under tension in response to the application of circulating fluid under controlled pressure thereby modulating the plug-stabilizer diameter.

17. The pressure differential drilling tool as set forth in claim 1, wherein the plug-stabilizer is comprised of a tubular body carrying an expandable sleeve over said port opening therein and sealed with the upper and lower portion of the tubular body to be inflated by circulating fluid under pressure, and wherein the expansion limiting means is a cage assembly surrounding the expandable sleeve and comprised of separably adjacent longitudinally disposed primary stave members bonded to the expandable sleeve and of overlapping separably adjacent longitudinally disposed secondary stave members in circumferential sliding engeagement over the primary stave members and bonded to a surrounding wear boot, there being inwardly turned ears at the upper and lower ends of the primary stave members and engaged with opposite stop shoulders at the upper and lower portions of the tubular body to anchor the stave members, and there being pins projecting from the upper and lower portions of the primary stave members and engaged with the upper and lower end portions of the secondary stave members for anchored engagement therewith, the primary and secondary stave members acting together subject to being stretched under tension in response to the application of circulating fluid under controlled pressure thereby modulating the plug-stabilizer diameter.

18. The pressure differential drilling tool as set forth in claim 1, wherein the plug-stabilizer is comprised of a tubular body carrying an expandable sleeve over said port opening therein and sealed with the upper and lower portion of the tubular body to be inflated by circulating fluid under pressure, and wherein the expansion limiting means is a cage assembly surrounding the expandable sleeve and comprised of separably adjacent longitudinally disposed primary stave members bonded to the expandable sleeve and of overlapping separably adjacent longitudinally disposed secondary stave members in circumferential sliding engagement over the primary stave members and bonded to a surrounding wear boot, there being inwardly turned ears at the upper and lower ends of the primary stave members and engaged with opposite stop shoulders at the upper and lower portions of the tubular body to anchor the stave members, and there being pins centered in and projecting from the upper and lower end portions of the primary stave members and engaged with complementary notches in the adjacent edges of the secondary stave members for anchored engagement therebetween, the primary and secondary stave members acting together subject to being stretched under tension in response to the application of circulating fluid under controlled pressure thereby modulating the plug-stabilizer diameter.

19. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is a cage assembly surrounding the expandable sleeve and comprised of separably adjacent longitudinally disposed primary stave members bonded to the expandable sleeve and of overlapping separably adjacent longitudinally disposed secondary stave members in circumferential sliding engagement over the primary stave members and bonded to a surrounding wear boot, there being inwardly turned ears at the upper and lower ends of the primary stave members and spaced from and engageable with opposite step shoulders at the upper and lower portions of the tubular body to anchor the primary stave members for limiting the plug-stabilizer to a nominal expanded diameter, and there being pins projecting from the upper and lower end portions of the primary stave members and engaged with the upper and lower end portions of the secondary stave members for anchored engagement therewith, the primary and secondary stave members acting together subject to being stretched under tension in response to the application of circulating fluid under controlled pressure thereby modulating the plug-stabilizer diameter.

20. The pressure differential drilling tool as set forth in claim 1, wherein the plug-stabilizer is comprised of a tubular body carrying an expandable sleeve over said port opening therein and sealed with the upper and lower portions of the tubular body to be inflated by circulating fluid under pressure, and wherein the expansion limiting means is a cage assembly surrounding the expandable sleeve and comprised of separably adjacent longitudinally disposed primary stave members bonded to the expandable sleeve and of overlapping separably adjacent longitudinally disposed secondary stave members in circumferential sliding engagement over the primary stave members and bonded to and surrounding a wear boot, there being inwardly turned ears at the upper and lower ends of the primary stave members and spaced from and engageable with opposite stop shoulders at the upper and lower portions of the tubular body to anchor the stave members for limiting the plug-stabilizer to a nominal expanded diameter, and there being pins centered in and projecting from the upper and lower portions of the primary stave members and engaged with complementary notches in the adjacent edges of the secondary stave members for anchored engagement therewith, the primary and secondary members acting together subject to being stretched under tension in response to the application of circulating fluid under controlled pressure thereby modulating the plug-stabilizer diameter.

21. The pressure differential drilling tool as set forth in claim 1, wherein the body conducting circulating fluid under pressure includes an internal bypass means from the bore of the drill string to the jet pump.

22. The pressure differential drilling tool as set forth in claim 21, wherein the body is sectional with a sub-body carrying a jet bit with flow restrictive jets, wherein bypass means through the sub-body shares circulating fluid from the internal bypass means to the jet pump, and wherein a bypass means from the bore annulus into the sub-body directs chip laden annulus fluid from the drilling zone to the jet pump.

23. The pressure differential drilling tool as set forth in claim 21, wherein the body is sectional with a sub-body carrying a jet bit with flow restrictive jets, wherein bypass means comprised of at least one passage through the sub-body shares circulating fluid from the internal bypass means to the jet pump and to the bit jets, and wherein bypass means comprised of at least one cross-over passage through the sub-body in in open communication between the well bore annulus of the drilling zone and into the jet pump.

24. The pressure differential drilling tool as set forth in claim 1, wherein the body conducting circulating fluid under pressure includes an internal bypass means that comprises at least one passage through the body from the bore of the drilling string to the jet pump.

25. The pressure differential drilling tool as set forth in claim 1, wherein the body includes an internal and downward bypass means for supplying supplemental flushing fluid under static head pressure from the well bore annulus above the plug-stabilizer to the well bore annulus below the plug-stabilizer.

26. The pressure differential drilling tool as set forth in claim 1, wherein the body includes an internal and downward bypass means that comprises at least one passage through the body from the well bore annulus above the plug-stabilizer to the well bore annulus below the plug-stabilizer.

27. The pressure differential drilling tool as set forth in claim 1, wherein the body includes an internal and downward bypass means that comprises at least one passage through the body from the well bore annulus above the plug-stabilizer to the well bore annulus below the plug-stabiizer, there being a restrictive flow bean in said at least one passage.

28. The pressure differential drilling tool as set forth in claim 1, wherein the body includes an internal and downward bypass means that comprises at least one passage through the body from the well bore annulus above the plug-stabilizer to the well bore annulus below the plug-stabilizer, there being a restrictive flow bean in said at least one passage, and a skirt rotating with the plug-stabilizer and having cutter openings at an interface with the inlet to said at least one passage to reduce chips.

29. The pressure differential drilling tool as set forth in claim 1, wherein the body includes an internal mud pressure bypass means for supplying supplemental flushing fluid under circulating fluid pressure from the bore of the drilling string to the well bore annulus below the plug-stabilizer.

30. The pressure differential drillng tool as set forth in claim 1, wherein the body includes an internal and pressure bypass means that comprises at least one passage through the body from the bore of the drilling string to the well bore annulus below the plug-stabilizer.

31. The pressure differential drilling tool as set forth in claim 1 wherein the body includes an internal mud pressure bypass means that comprises at least one passage through the body from the bore of the drilling string to the well bore annulus below the plug-stabilizer, there being a restrictive flow bean in said at least one passage.

32. A pressure differential drilling tool for reducing circulating fluid pressure in a drilling zone at the bit-to-bore bottom interface of a drill bit operated by a drilling string to continuously make hole in a well bore and including;

a body coupled to the lower end of the drilling string and carrying the drill bit for bit-to-bore bottom engagement and conducting circulating fluid under pressure and for removing formation chips from the bore bottom, an expandable plug-stabilizer rotatably surrounding the body on bearings to advance down-hole therewith and having expansion limiting means restricting the plug-stabilizer to less than the diameter of the well bore for free sliding engagement therein within a controlled annulus bypass between the plug-stabilizer and the surrounding well bore for isolationg of the well bore annulus above the plug-stabilizer from said drilling zone below the plug-stabilizer, and a peripheral nozzle jet pump comprised of an inlet tube open from said drilling zone and a diffuser open into the well bore above the plug-stabilizer, and both of substantially the same bore diameter and in spaced coaxial opposition to establish an annular ejection nozzle therebetween for the entrainment of chip laden mud circulating fluid flowing unobstructedly through said suction tube and diffuser bores, and significantly reducing the pressure thereof within the drilling zone below the plug-stabilizer.

33. The pressure differential drilling tool as set forth in claim 32, wherein the body is sectional with a sub-body carrying the drill bit and the peripheral nozzel jet pump comprised of coaxially coupled formation of the body and sub-body.

34. The pressure differential drilling tool as set forth in claim 32, wherein the body is sectional with a sub-body carrying the drill bit and the peripheral nozzle jet pump comprised of coaxially coupled formations of the body and sub body with an annular plenum surrounding the suction tube in communication with the nozzle and supplying circulating fluid under pressure thereto.

35. The pressure differential drilling tool as set forth in claim 34, wherein the body conducting circulating fluid under pressure includes an internal bypass means that comprises at least one passage through the body from the bore of the drilling string to the annular plenum surrounding and supplying circulating fluid to the peripheral nozzle jet pump.

36. The pressure differential drilling tool as set forth in claim 32, wherein the body is sectional with a sub-body carrying the drill bit and the peripheral nozzle jet pump comprised of the suction tube and diffuser and at least one of which is a separable element captured by coaxial coupled engagement of the body and sub-body.

37. The pressure differential drilling tool as set forth in claim 32, wherein the body is sectional with a sub-body carrying the drill bit and the peripheral jet pump comprised of a suction tube and a diffuser and at least one of which is axially positioned by means adjusting the orifice of the annular nozzle thereof.

38. The pressure differential drilling tool as set forth in claim 32, wherein the body is sectional with a sub-body carrying the drill bit and the peripheral jet pump comprised of a suction tube having a convergent exterior conical wall termination at a sharp lip with the bore thereof, and the diffuser having a convergent inner conical wall termination obtusely with the bore thereof, said two conical walls establishing the annular jet pump nozzle.

39. The pressure differential drilling tool as set forth in claim 32, wherein the body conducting circulating fluid under pressure includes an internal bypass from the bore of the drill string to the annular ejecting nozzle of the peripheral nozzle jet pump.

40. A method of annulus bypass underbalanced rotary drilling of a well bore, and including;

rotating a drilling string made up of a drill pipe supplied with circulating fluid under pressure and with the weight thereof applied to a drill bit at the lower end thereof to penetrate the bit-to-bore bottom interface for continuously making hole, placing a pressure expandable plug-stabilizer immediately above the drill bit and rotating the drilling string therethrough and defining a drilling zone below the plug-stabilizer, reducing the circulating fluid pressure in the drilling zone by pump means operating as a result of the flow of circulating fluid under pressure to the drill bit, and sharing the circulating fluid pressure with the pressure expandable plug-stabilizer to expand the same to the proximate diameter of the well bore to modulate a downward annulus bypass surrounding the plug-stabilizer to control the flow of circulating fluid into the drilling zone while continuously making hole.

* * * * *